US008683975B2

(12) United States Patent
Tinney

(10) Patent No.: US 8,683,975 B2
(45) **Date of Patent: *Apr. 1, 2014**

(54) POSITIVE DISPLACEMENT ROTARY SYSTEM

(76) Inventor: Joseph F. Tinney, Ashburn, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/530,220

(22) Filed: Jun. 22, 2012

(65) Prior Publication Data

US 2012/0263617 A1 Oct. 18, 2012

Related U.S. Application Data

(63) Continuation of application No. 13/046,908, filed on Mar. 14, 2011, now Pat. No. 8,225,767, which is a continuation-in-part of application No. 13/042,831, filed on Mar. 8, 2011, now abandoned.

(60) Provisional application No. 61/313,833, filed on Mar. 15, 2010.

(51) Int. Cl.
*F02B 53/08* (2006.01)
*F02B 53/04* (2006.01)

(52) U.S. Cl.
USPC ..... 123/212; 123/231; 123/234; 123/235; 123/236

(58) Field of Classification Search
USPC ..... 123/212–215, 221, 224–231, 234–237, 123/239, 240; 418/212–214
See application file for complete search history.

(56) References Cited

U.S. PATENT DOCUMENTS

| | | | | |
|---|---|---|---|---|
| 58,086 | A | | 9/1866 | Fletcher |
| 899,027 | A | | 9/1908 | Burton |
| 1,749,058 | A | | 3/1930 | Barlow |
| 1,777,932 | A | | 10/1930 | Nixon |
| 1,969,192 | A | | 8/1934 | Williams et al. |
| 2,179,401 | A | | 11/1939 | Chkliar |
| 2,246,273 | A | * | 6/1941 | Davidson ..... 418/77 |
| 2,316,318 | A | | 4/1943 | Davidson |
| 2,682,258 | A | | 6/1954 | Udelman |
| 3,070,078 | A | | 12/1962 | Dillenberg |
| 3,103,919 | A | | 9/1963 | Drapeau |
| 3,289,653 | A | | 12/1966 | Kuttes |
| 3,487,816 | A | | 1/1970 | Wild et al. |

(Continued)

OTHER PUBLICATIONS

Abstract of M. Kano, "DLC Coating Technology Applied to Sliding Parts of Automotive Engine", New Diamond and Frontier Carbon Technology, vol. 16, No. 4 (2006).

(Continued)

*Primary Examiner* — Mary A Davis
(74) *Attorney, Agent, or Firm* — Banner & Witcoff, Ltd.

(57) ABSTRACT

A positive displacement rotary system may include a main rotor and a slotted rotor. The main rotor can include an interior cavity and a fixed vane (or blade) that is attached to the peripheral and side walls of that cavity. The slotted rotor is positioned within the main rotor interior and includes a slot for the main rotor blade. The main and slotted rotors rotate about parallel axes that are offset from one another. As the rotors turn, separate chambers are formed between the blade and an inter-rotor seal, with the inter-rotor seal located at or near a rolling contact between the outer surface of the slotted rotor and an inner perimeter wall of the main rotor cavity. The separate chambers contract and expand as the rotors rotate.

14 Claims, 32 Drawing Sheets

(56) References Cited

U.S. PATENT DOCUMENTS

| | | | | |
|---|---|---|---|---|
| 3,537,432 | A | | 11/1970 | Jordaan |
| 3,572,030 | A | | 3/1971 | Cuff |
| 3,572,985 | A | | 3/1971 | Runge |
| 3,693,601 | A | | 9/1972 | Sauder |
| 3,781,146 | A | | 12/1973 | Bates |
| 3,796,196 | A | | 3/1974 | Baker |
| 3,809,026 | A | | 5/1974 | Snyder |
| 3,861,362 | A | | 1/1975 | Kenyon |
| 3,902,465 | A | | 9/1975 | Stookey |
| 3,918,414 | A | | 11/1975 | Hughes |
| 3,949,711 | A | | 4/1976 | Shobert, II |
| 3,951,109 | A | | 4/1976 | Chappellier |
| 3,957,021 | A | | 5/1976 | Loyd, Jr. |
| 4,004,556 | A | | 1/1977 | Pfeiffer |
| 4,355,965 | A | | 10/1982 | Lowther |
| 4,396,365 | A | | 8/1983 | Hayashi |
| 4,487,562 | A | | 12/1984 | Inagaki et al. |
| 4,545,337 | A | | 10/1985 | Lyons et al. |
| 4,553,513 | A | | 11/1985 | Miles et al. |
| 4,638,776 | A | | 1/1987 | Crittenden |
| 4,667,468 | A | | 5/1987 | Hansen |
| 4,673,343 | A | * | 6/1987 | Moore ..... 418/173 |
| 4,776,074 | A | | 10/1988 | Suzuki et al. |
| 4,801,251 | A | | 1/1989 | Nakajima et al. |
| 4,820,140 | A | | 4/1989 | Bishop |
| 4,822,263 | A | | 4/1989 | Nakajima et al. |
| 4,830,590 | A | | 5/1989 | Sumikawa et al. |
| 4,864,985 | A | | 9/1989 | Slee |
| 4,949,540 | A | | 8/1990 | Wich |
| 5,103,778 | A | | 4/1992 | Usich, Jr. |
| 5,191,863 | A | | 3/1993 | Hagiwara |
| 5,235,945 | A | | 8/1993 | Testea |
| 5,247,916 | A | | 9/1993 | Riney |
| 5,277,158 | A | | 1/1994 | Pangman |
| 5,302,096 | A | | 4/1994 | Cavalleri |
| 5,310,326 | A | | 5/1994 | Gui et al. |
| 5,474,036 | A | | 12/1995 | Hansen et al. |
| 5,479,887 | A | | 1/1996 | Chen |
| 5,494,014 | A | | 2/1996 | Lobb |
| 5,509,388 | A | | 4/1996 | Andres |
| 5,522,356 | A | | 6/1996 | Palmer |
| 5,524,586 | A | | 6/1996 | Mallen |
| 5,540,054 | A | | 7/1996 | Bullivant |
| 5,568,796 | A | | 10/1996 | Palmer |
| 5,571,244 | A | | 11/1996 | Andres |
| 5,595,154 | A | | 1/1997 | Smith |
| 5,711,268 | A | | 1/1998 | Holdampf |
| 5,727,517 | A | | 3/1998 | Mallen |
| 5,776,600 | A | | 7/1998 | Katayama et al. |
| 5,819,699 | A | | 10/1998 | Burns |
| 5,839,399 | A | | 11/1998 | Luce |
| 5,866,518 | A | | 2/1999 | Dellacorte et al. |
| 5,882,183 | A | | 3/1999 | Andres |
| 5,979,395 | A | | 11/1999 | Mallen et al. |
| 6,039,552 | A | * | 3/2000 | Mimura ..... 418/166 |
| 6,062,188 | A | | 5/2000 | Okamura |
| 6,135,720 | A | | 10/2000 | Boller |
| 6,289,872 | B1 | | 9/2001 | Dardalis |
| 6,293,242 | B1 | | 9/2001 | Kutlucinar |
| 6,371,745 | B1 | | 4/2002 | Bassine |
| 6,443,110 | B2 | | 9/2002 | Qattan |
| 6,497,564 | B2 | | 12/2002 | Klassen |
| 6,523,833 | B1 | | 2/2003 | Ishigaki et al. |
| 6,526,937 | B1 | | 3/2003 | Bolonkin |
| 6,536,403 | B1 | | 3/2003 | Elsherbini |
| 6,539,913 | B1 | | 4/2003 | Gardiner |
| 6,543,394 | B2 | | 4/2003 | Tinney |
| 6,548,173 | B2 | | 4/2003 | Erdemir et al. |
| 6,584,963 | B2 | | 7/2003 | Arnold |
| 6,659,066 | B1 | | 12/2003 | Lee |
| 6,718,933 | B1 | | 4/2004 | Coates |
| 6,779,504 | B2 | | 8/2004 | Coates |
| 6,789,516 | B2 | | 9/2004 | Coates |
| 6,796,285 | B2 | | 9/2004 | Karnes |
| 6,932,354 | B2 | | 8/2005 | Kane et al. |
| 7,077,098 | B2 | | 7/2006 | Shuba |
| 7,131,405 | B2 | | 11/2006 | Lawes |
| 7,178,617 | B2 | | 2/2007 | Morisawa et al. |
| 7,230,399 | B2 | | 6/2007 | Kuribayashi et al. |
| 7,251,118 | B2 | | 7/2007 | Nevin |
| 7,314,035 | B2 | | 1/2008 | Akmandor et al. |
| 7,395,805 | B1 | | 7/2008 | MacMurray |
| 7,406,938 | B2 | | 8/2008 | Lawes |
| 7,478,628 | B2 | | 1/2009 | Hines |
| 7,479,001 | B2 | | 1/2009 | Stroganov et al. |
| 7,563,080 | B2 | | 7/2009 | Masuda |
| 7,647,909 | B2 | | 1/2010 | Coates |
| 8,225,767 | B2 | * | 7/2012 | Tinney ..... 123/212 |
| 2003/0209221 | A1 | | 11/2003 | Klassen |
| 2008/0121207 | A1 | | 5/2008 | Pelov |
| 2008/0216792 | A1 | | 9/2008 | Hartfield |
| 2010/0018490 | A1 | | 1/2010 | Varga |

OTHER PUBLICATIONS

Abstract of Hersberger, J., et al., "Friction and Wear Behavior of Near-Frictionless Carbon Coatings in Forumlated Gasolines", Surface & Coating Technology, 183, 2004, pp. 111-117.

Kovalchenko, A., et al., "Friction and Wear Performance of Low-Friction Carbon Coatings Under Oil Lubrication", Energy Technology Div., Argonne National Laboratory, published prior to Mar. 8, 2011.

Ajayi, O., et al., "Effect of Carbon Coating on Scuffing Performance in Diesel Fuels", Tribology Transactions, vol. 44, 2001, pp. 298-304.

NASA, Glenn Research Center, Fact Sheet, "Creating a Turbomachinery Revolution", published prior to Mar. 8, 2011.

International Search Report and Written Opinion for PCT/US11/28346 dated May 5, 2011.

* cited by examiner

POSITIVE DISPLACEMENT ROTARY SYSTEM

CROSS-REFERENCE TO RELATED APPLICATIONS

This application is a continuation of U.S. patent application Ser. No. 13/046,908 filed Mar. 14, 2011, (now U.S. Pat. No. 8,225,767), which application is a continuation-in-part of U.S. patent application Ser. No. 13/042,831 filed Mar. 8, 2011, which application claims priority to Provisional U.S. Patent Application Ser. No. 61/313,833, filed Mar. 15, 2010, and titled "Multi-Rotor Internal Combustion Engine"; the contents of each of these applications in its entirety is incorporated by reference herein.

BACKGROUND

There are various known mechanisms for effecting positive displacement compression and/or expansion in engines, pumps, compressors and other devices. For example, reciprocating engines can employ pistons within cylinders to compress an air fuel mixture and to then output a mechanical force as that air fuel mixture is ignited and expands. Although reciprocating engines and other piston-based positive displacement systems are in wide use, such systems have numerous disadvantages. Piston-based systems can be quite complex and have numerous moving parts. The reciprocating nature of the piston motion can limit the speed at which an engine or other piston-based device can operate. Other disadvantages are well known.

Other types of positive displacement systems utilize rotary motion. For example, some rotary engines and pumps employ one or more vanes coupled to a rotor that turns within a cavity. The vanes maintain sliding contact with the cavity walls and define one or more chambers that vary in volume as the rotor turns. Such designs can have certain limitations, however. For example, maintaining an effective seal between the tip of a vane and a cavity wall can be problematic. Moreover, "chattering" can occur between vanes and the cavity wall. To overcome these and other problems, some designs may include a relatively large number of vanes or otherwise include features that increase complexity.

There remains a need for improved positive displacement rotary systems that can be utilized for internal combustion engines, compressors, pumps and other devices.

SUMMARY

This Summary is provided to introduce a selection of concepts in a simplified form that are further described below in the Detailed Description. This Summary is not intended to identify key features or essential features of the invention.

In at least some embodiments, a positive displacement rotary system may include a main rotor and a slotted rotor. The main rotor can include an interior cavity and a fixed vane (or blade) that is attached to the peripheral and side walls of that cavity. The slotted rotor is positioned within the main rotor interior and includes a slot for the main rotor blade. The main and slotted rotors rotate about parallel axes that are offset from one another. As the rotors turn, separate chambers are formed between the blade and an inter-rotor seal, with the inter-rotor seal located at or near a rolling contact between the outer surface of the slotted rotor and an inner perimeter wall of the main rotor cavity. The separate chambers contract and expand as the rotors rotate.

Additional embodiments include systems that incorporate one or more main and slotted rotor pairs. Such systems include, but are not limited to, a rotary internal combustion engine, a fluid compressor, a pump, a fluid driven motor, a turbocharger, a combination internal combustion engine and motor/generator, and other systems. Additional embodiments include main and slotted rotor pairs that include additional blades and/or one or more additional slotted rotors.

DETAILED DESCRIPTION

Figure 1C:
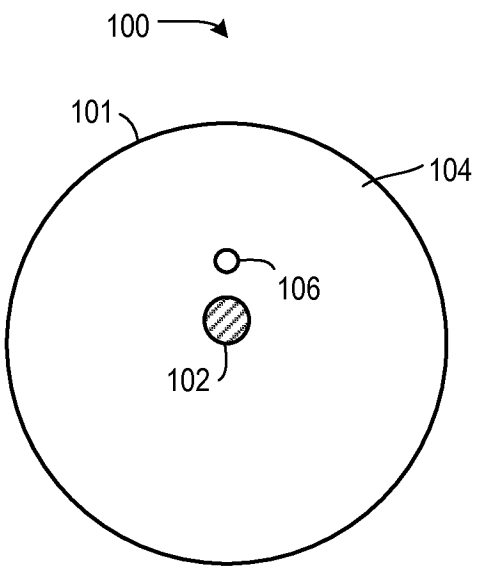
FIGS. 1A-1C are front, side and rear views, respectively, of a combination rotary engine and motor/generator according to some embodiments.
Figure 1B:
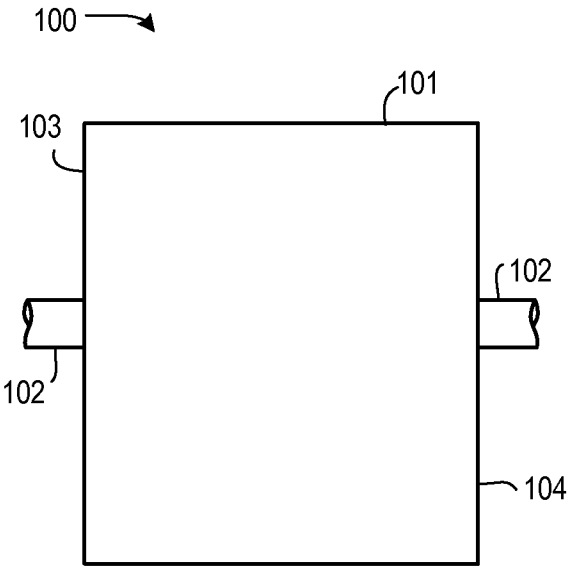
Figure 1A:
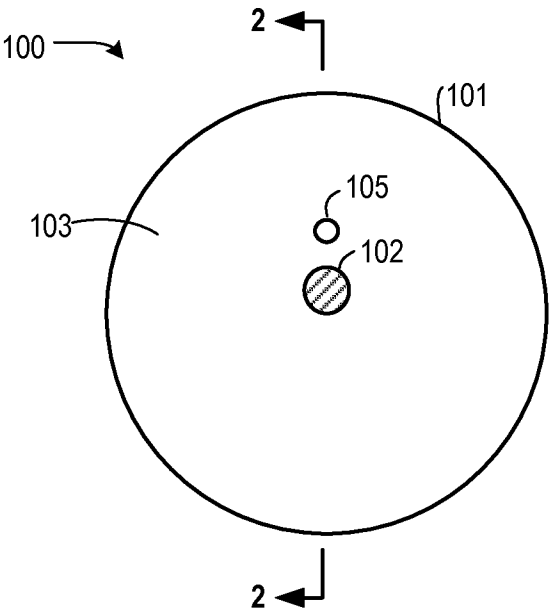

FIG. 1A is a front view of a combination rotary engine and motor/generator 100 according to some embodiments. For simplicity, engine and motor/generator 100 may be referred to simply as "engine 100." FIGS. 1B and 1C are side and rear views, respectively, of engine 100. Engine 100 includes a housing 101. A shaft 102 extends through a front face 103 and a rear face 104 of housing 101. An air intake port 105 is located in front face 103. An exhaust port 106 is located in rear face 104.

For convenience, certain elements are not shown in FIGS. 1A-1C. For example, housing 101 could be divided into one or more sections that are secured together with bolts and sealed with one or more gaskets. Housing 101 may also contain one or more openings through which a wiring harness could extend so as to connect internal motor/generator elements to external loads, to a battery, etc. Housing 101 may also contain one or more openings through which cooling fluid lines may pass, openings through which a fuel line or other fuel conduit may carry fuel to a combustion chamber within housing 101, etc. The selection of locations for these and other elements would be a matter of routine design choice for a person of ordinary skill in the art once such a person has been provided with the information disclosed herein and within the accompanying drawing figures.

Figure 2:
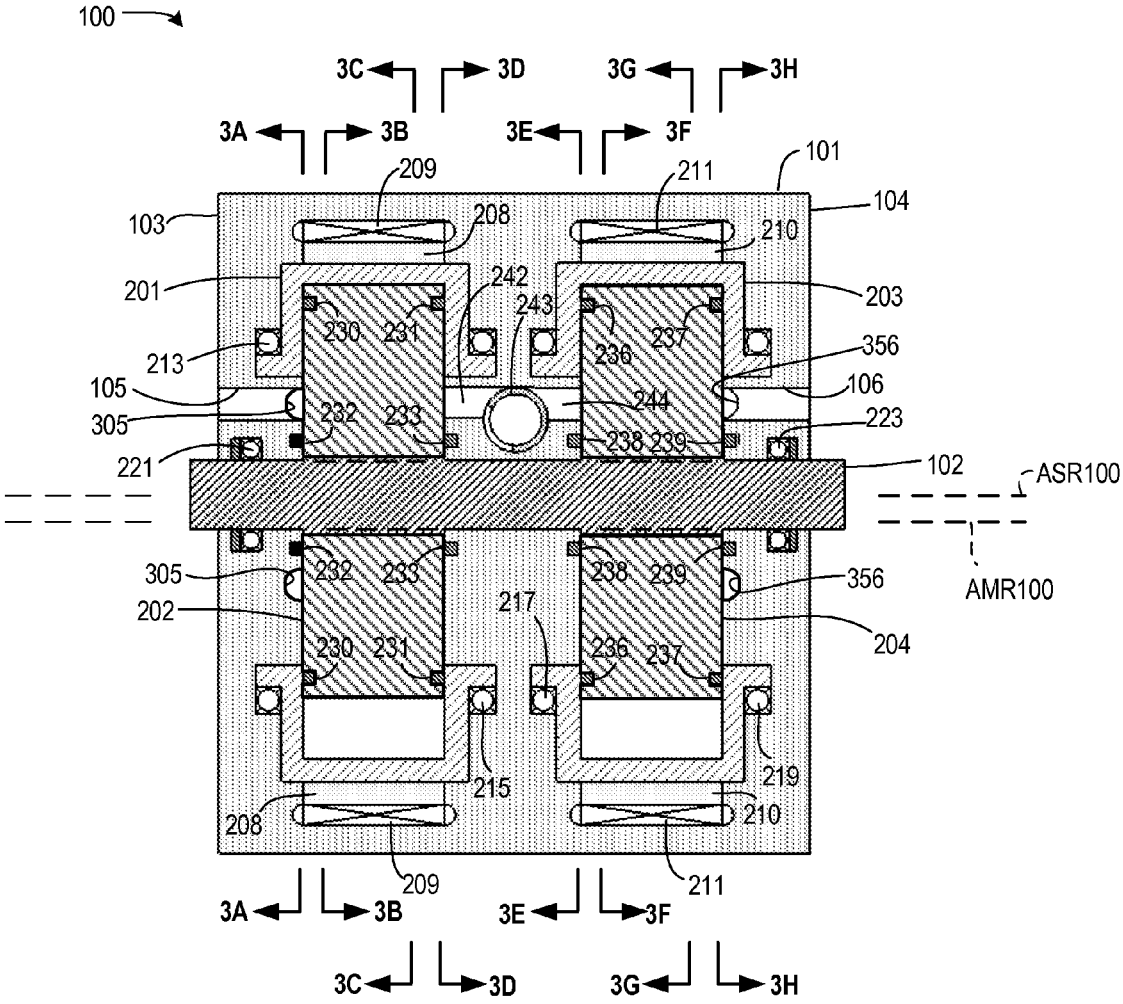
FIG. 2 is a cross-sectional view taken from the location indicated in FIG. 1A.

FIG. 2 is a cross-sectional view of engine 100 taken from the location indicated in FIG. 1A. The front portion of engine 100 includes an intake/compression main rotor 201 and an intake/compression slotted rotor 202. The rear portion of engine 100 includes an expansion/exhaust main rotor 203 and an expansion/exhaust slotted rotor 204. Each of main rotors 201 and 203 rotates about a main rotor axis AMR100. Each of slotted rotors 202 and 204 are attached to shaft 102. Slotted rotors 202 and 204 and shaft 102 all rotate about a slotted rotor axis ASR100. As seen in FIG. 2, axes AMR100 and ASR100 are offset from one another.

Casing 101 includes internal components that can be configured to operate as a motor/generator. As used herein, "motor/generator" also includes combinations of components that can be configured for operation as a motor or as an alternator. Motor/generator windings and other components (e.g., permanent magnets in some embodiments) are located on the circumferences of main rotors 201 and 203. In the embodiment of engine 100, an armature 208 is attached to the outer periphery of main rotor 201 and rotates relative to a stator 209 attached to an inside wall of housing 101. An armature 210 is similarly attached to the outer periphery of main rotor 203 and rotates relative to a stator 211 also attached to an inside wall of housing 101. Armatures 208 and 210 and stators 209 and 211 can be used as a motor to rotate rotors 201-204 when starting engine 100. After engine 100 has been started and a self-sustaining internal combustion cycle is underway, the rotation of armatures 208 and 210 within stators 209 and 211 can then be used to generate electrical power. Although each of rotors 201 and 203 includes an armature configured to rotate within a corresponding stator, other embodiments include engine and motor/generators in which only a single rotor includes an armature. For example, other embodiments could include engines in which only one main/slotted rotor pair includes motor/generator components.

Main rotor 201 is rotationally supported by bearings 213 and by bearings 215. Main rotor 203 is rotationally supported by bearings 217 and by bearings 219. Shaft 102 is rotationally supported by bearings 221 and by bearings 223.

A front ring seal 230 is located on the front side of slotted rotor 202. A similar rear ring seal 231 is located on the rear side of slotted rotor 202. Seals 230 and 231, which may be fixed relative to slotted rotor 202 and move relative to the inside surfaces of main rotor 201, help to seal inter-rotor chambers formed between slotted rotor 202 and main rotor 201. The operation of those chambers is discussed below in connection with FIGS. 6A-6F. A front ring seal 232 and a rear ring seal 233 are located in housing 101. Ring seal 233, in conjunction with seal 230, helps to prevent leakage of compressed air being transferred to the expansion/exhaust side of engine 100. Seal 232, in conjunction with seal 230, helps to ensure that the intake into a chamber between rotors 201 and 202 is from port 105 by, e.g., excluding intake from interior spaces of casing 101 that surround main rotor 201. For certain embodiments in which the ring seals are exposed to temperatures between −40° C. (−40° F.) and 100° C. (212° F.), ring seal materials could include Buna-N, fluorosilicone, silicone, neoprene, TEFLON, VITON, rubber, nitrile, and the like. For embodiments in which ring seals may be exposed to temperatures above 100° C., ring seal materials could include graphite, carbon graphite, self-lubricating fluoride-metal composites such as fluoride-nichrome, high temperature materials coated with low friction diamond-like carbon, and the like.

A front ring seal 236 is located on the front side of slotted rotor 204. A similar rear ring seal 237 is located on the rear side of slotted rotor 204. Seals 236 and 237, which may be fixed relative to slotted rotor 204 and move relative to the inside surfaces of main rotor 203, help to seal inter-rotor chambers formed between slotted rotor 204 and main rotor 203. The operation of those chambers is discussed below in connection with FIGS. 7A-7F. A front ring seal 238 and a rear ring seal 239 are located in housing 101. Ring seal 238, in conjunction with seal 236, helps to prevent leakage of expanding air. Seal 239, in conjunction with seal 237, helps to ensure that exhaust gases are expelled through port 106 and not forced into spaces of casing 101 that surround main rotor 203. Ring seals 236-239 can be formed from materials similar to those used to form ring seals 230-233.

Fresh air is drawn into the intake/compression side of engine 100 through intake port 105. Port 105 leads to an annular air supply manifold 305, which manifold is described in more detail below. Fresh air drawn from manifold 305 is compressed between main rotor 201 and slotted rotor 202, as is also discussed below, and then output through a compressed air channel 242.

Channel 242 feeds into a combustion chamber 243. Although not shown in FIG. 2, combustion chamber 243 also includes a fuel injector and an anti-backflow valve. In some embodiments that utilize gasoline as fuel for engine 100, combustion chamber 243 may include a spark plug, glow plug or other ignition source. In certain other embodiments that utilize gasoline as a fuel, chamber 243 may include a fuel injector, and an ignition source can be included within an inter-rotor expansion chamber of rotors 203 and 204. Such an ignition source could be incorporated into a portion of the outside surface of slotted rotor 204. In some embodiments, engine 100 could be configured for operation using any of multiple fuel types and include multiple ignition sources. For example, a first ignition source could be included in chamber 243 and a second included within an inter-rotor expansion chamber. When using diesel fuel, kerosene, and various other fuel types, the first ignition source could be used and the second ignition source deactivated. When using gasoline or various other types of fuel, the first ignition source could be deactivated and the second ignition source used. In still other embodiments, chamber 243 may not include a fuel injector. For example, some embodiments could receive a fuel/air mixture from a carburetor located upstream from rotors 201 and 202 in intake 105.

Returning to FIG. 2, compressed air and combustion products flow from chamber 243 through channel 244 and into an expansion inter-rotor chamber between main rotor 203 and slotted rotor 204. After the expansion of the compressed air and combustion products forces rotation of rotors 203 and 204 (and thus of rotors 201 and 202), the exhaust is scavenged and pushed out through exhaust port 106.

Figure 3A:
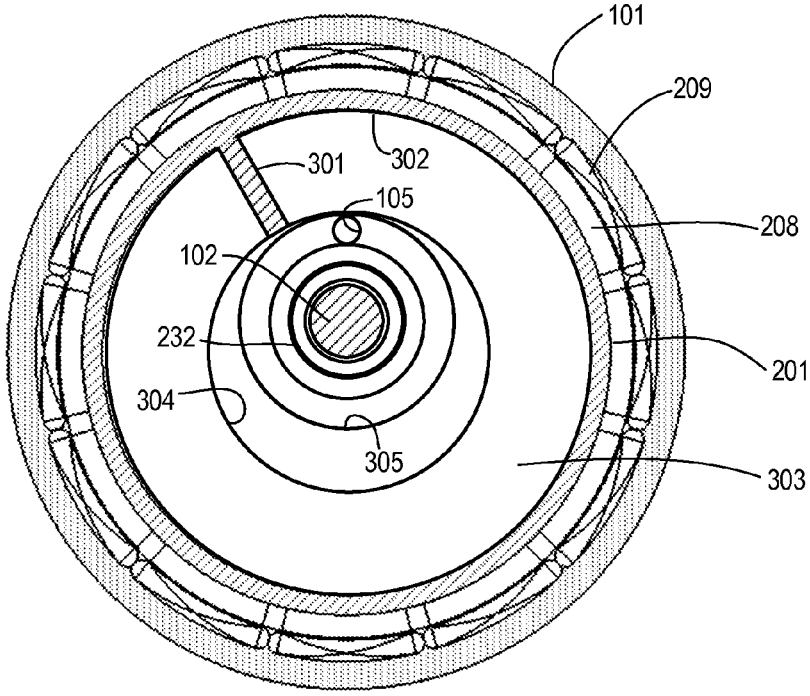
FIGS. 3A-3H are cross-sectional views taken from the locations indicated in FIG. 2.

FIG. 3A is a cross-sectional view of engine 100 from the first location indicated in FIG. 2. The sectioning plane is positioned on the front side of slotted rotor 202 and the view of FIG. 3A faces toward the front of engine 100. As partially seen in FIG. 3A, a blade 301 is fixed to the inner perimeter wall 302 and the inner front wall 303 of main rotor 201. An inner circumferential opening 304 in main rotor 201 exposes an inner front face of housing 101 and several components located thereon. For example, seal 232 (discussed above) is visible. Also visible is an annular manifold 305 which connects to air intake 105. A check valve (not shown) could be located in intake 105.

Figure 3B:
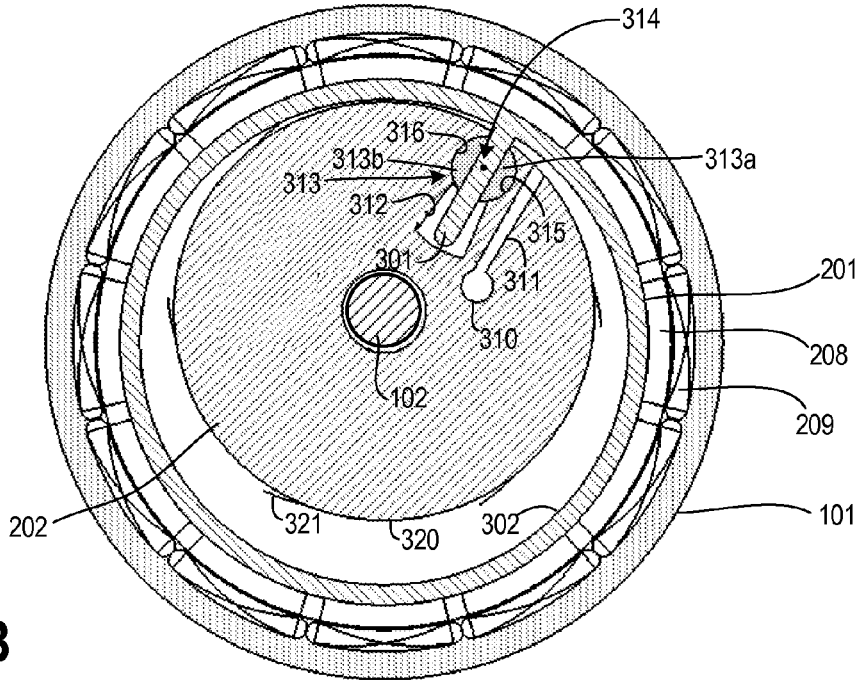

FIG. 3B is a cross-sectional view of engine 100 taken from the second location indicated in FIG. 2. The sectioning plane is positioned just to the rear of ring seal 230 and the view of FIG. 3B faces toward the rear of engine 100. Slotted rotor 202 includes an inlet port 310 that is connected to an inlet channel 311. As explained in more detail in connection with FIGS. 4A-4C, only port 310 is exposed on the front side of rotor 202. Channel 311 is only visible in FIG. 3B because of the location of the cross-sectional plane.

Slotted rotor 202 further includes a slot 312 and a split-trunnion seal 313. Seal 313 includes two halves 313*a* and 313*b* having shapes in the form of cylinder portions. Seal half 313*a* is adjacent wall section 315 and seal half 313*b* is adjacent wall section 316. Walls 315 and 316 have cylindrical shapes corresponding to the outer faces of seal halves 313*a* and 313*b*. Blade 301 is located within a slot formed by the inner faces of halves 313*a* and 313*b*. As rotors 201 and 202 rotate, and as discussed below in connection with FIGS. 6A-6F, seal 313 rotates in an oscillatory manner about axis 314 while blade 301 slides in and out of seal 313. Seal 313 prevents leakage of gases through slot 312 and around the interior tip of blade 301. Seal 313 can be formed from materials similar to those used to form ring seals 230-233.

Slotted rotor 202 also includes limited radial extension leaf seals 321 on the outer edge 320 at approximately 60° intervals. Leaf seals 321, which help to prevent leakage of gases between portions of rotors 201 and 202 in rolling contact and create an inter-rotor seal, are further discussed below.

Figure 3C:
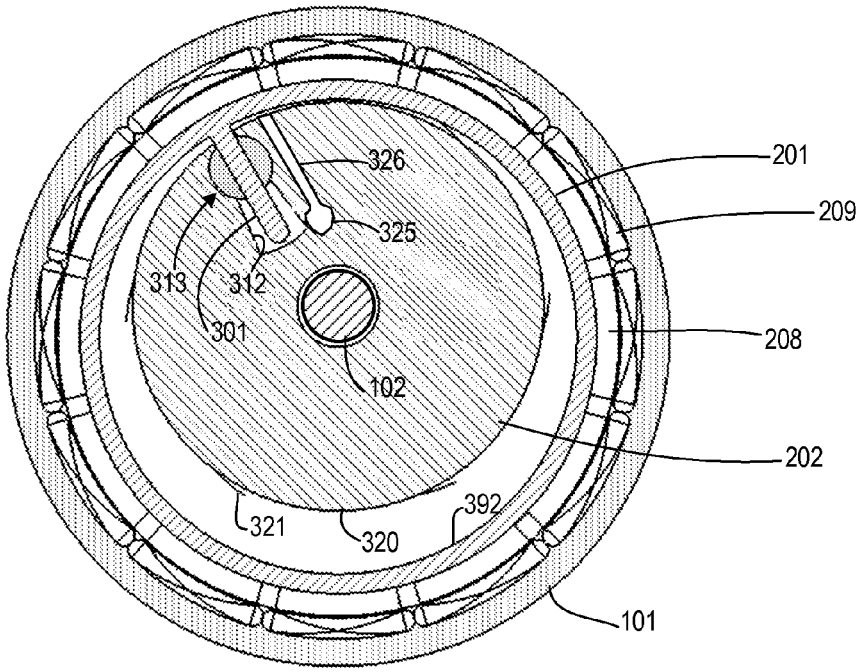

FIG. 3C is a cross-sectional view of engine 100 taken from the third location indicated in FIG. 2. The sectioning plane is positioned just forward of ring seal 231. The view of FIG. 3C faces toward the front of engine 100. Slotted rotor 202 further includes an outlet port 325 that is connected to an outlet channel 326. As explained in more detail in connection with FIGS. 4A-4C, only port 325 is exposed on the rear side of rotor 202. Channel 326 is only visible in FIG. 3C because of the location of the cross-sectional plane.

Figure 3D:
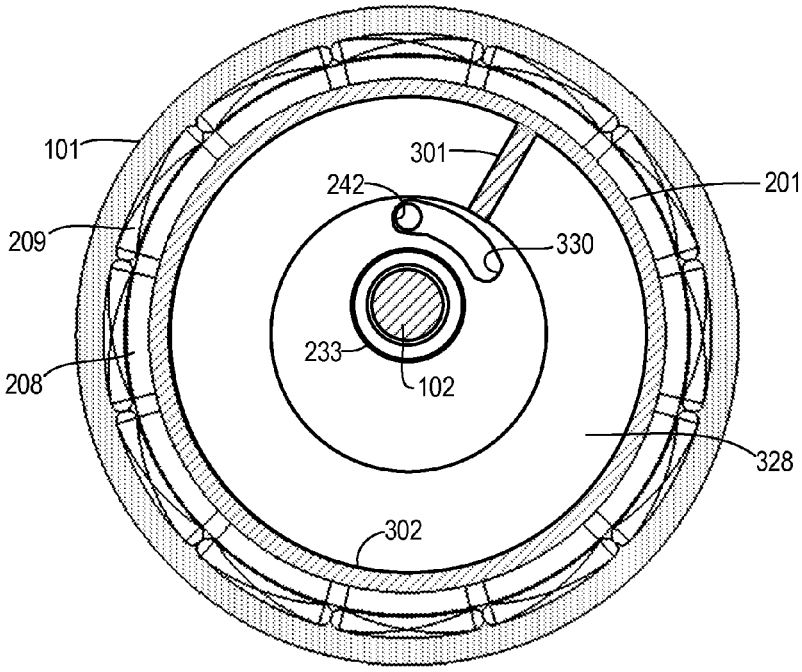

FIG. 3D is a cross-sectional view of engine 100 from the fourth location indicated in FIG. 2. The sectioning plane is positioned on the rear side of slotted rotor 202 and the view of FIG. 3D faces toward the rear of engine 100. Blade 301 is also fixed to an inner rear wall 328 of main rotor 201. An inner circumferential opening 329 in main rotor 201 exposes an inner face of housing 101 and several components located thereon. For example, seal 233 (discussed above) is visible. Also visible is an arcuate manifold which connects to compressed air channel 242 (FIG. 2).

Figure 3E:
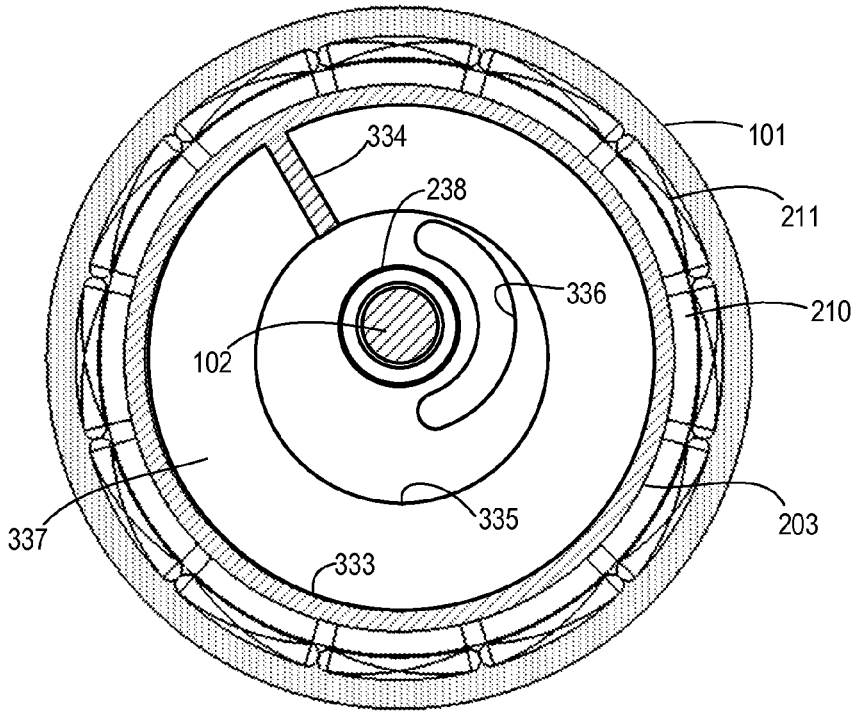

As seen in FIGS. 3E through 3H, the configuration of main rotor 203 and slotted rotor 204 are very similar to the configuration of main rotor 201 and slotted rotor 202. FIG. 3E is a cross-sectional view of engine 100 from the fifth location indicated in FIG. 2. The sectioning plane is positioned on the front side of slotted rotor 204 and the view of FIG. 3E faces toward the front of engine 100. As partially seen in FIG. 3E, a blade 334 is fixed to an inner perimeter wall 333 and an inner front wall 337 of main rotor 203. An inner circumferential opening 335 in main rotor 201 exposes an inner face of housing 101 and several components located thereon. For example, seal 238 (discussed above) is visible. Also visible is an arcuate manifold 336 which connects to channel 244 (FIG. 2). In some embodiments, arcuate manifold 336 extends over approximately 170° of the rotation of rotor 204 so as to minimize back pressure when a valve in chamber 243 admits the next charge of heated and compressed air into chamber 243 and an inter-rotor chamber of rotors 203 and 204.

Figure 3F:
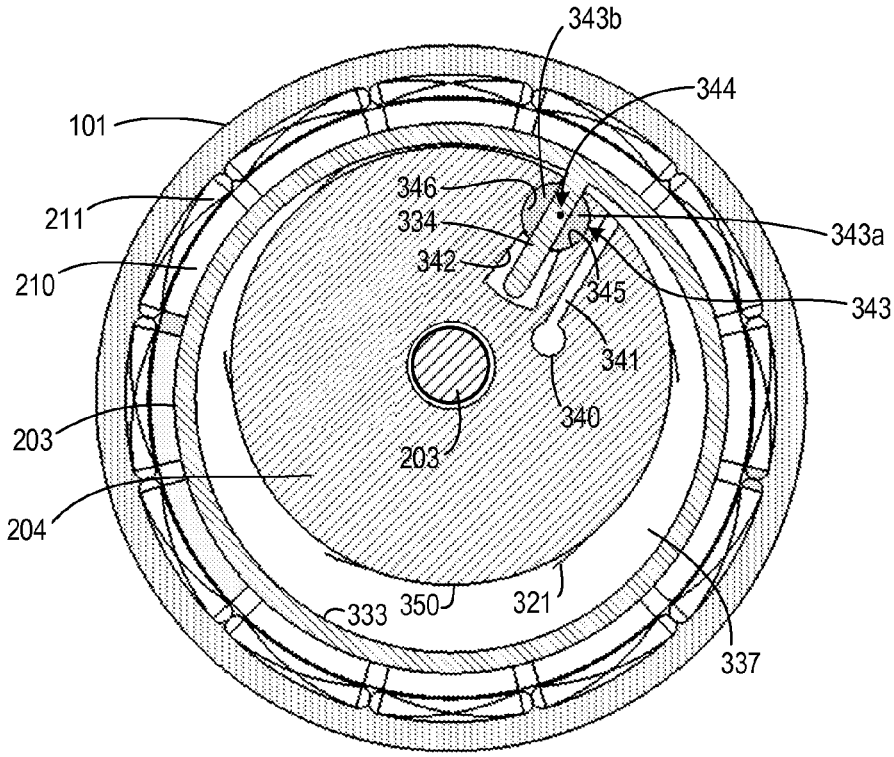

FIG. 3F is a cross-sectional view of engine 100 taken from the sixth location indicated in FIG. 2. The sectioning plane is positioned just to the rear of ring seal 236 and the view of FIG. 3F faces toward the rear of engine 100. Slotted rotor 204 includes an inlet port 340 that is connected to an inlet channel 341. As explained in more detail in connection with FIGS. 4A-4C, only port 340 is exposed on the front side of rotor 204. Channel 341 is only visible in FIG. 3F because of the location of the cross-sectional plane. Slotted rotor 204 further includes a slot 342 and a split-trunnion seal 343. Seal 343 includes two halves 343*a* and 343*b* having shapes in the form of cylinder portions. Seal half 343*a* is adjacent wall section 345 and seal half 313*b* is adjacent wall section 346. Walls 345 and 346 have cylindrical shapes corresponding to the outer faces of seal halves 343*a* and 343*b*. Blade 334 is located within a slot formed by the inner faces of halves 343*a* and 343*b*. As rotors 202 and 204 rotate, and as discussed below in connection with FIGS. 7A-7F, seal 343 rotates in an oscillatory manner about axis 344 while blade 334 slides in and out of seal 343. Seal 343 prevents leakage of gases through slot 342 and around the tip of blade 334. Slotted rotor 204 further includes leaf seals 321 on the outer edge 350 at approximately 60° intervals. Leaf seals 321 help to create an inter-rotor seal and prevent leakage of gases between portions of rotors 203 and 204 in rolling contact.

Figure 3G:
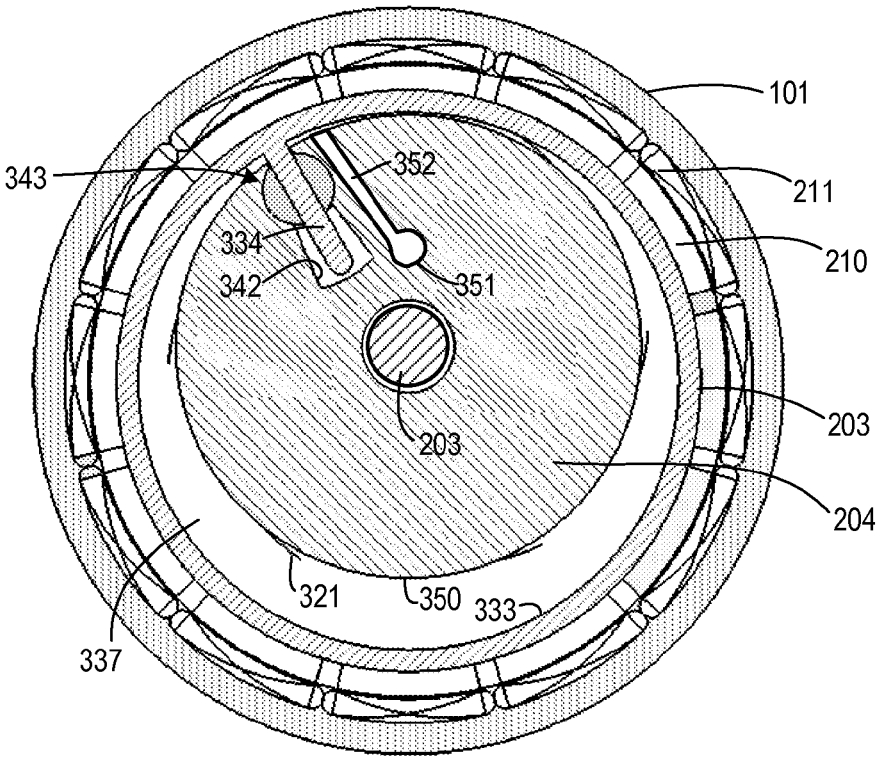

FIG. 3G a cross-sectional view of engine 100 taken from the seventh location indicated in FIG. 2. The sectioning plane is positioned just forward of ring seal 237. The view of FIG. 3G faces toward the front of engine 100. Slotted rotor 204 further includes an outlet port 351 that is connected to an outlet channel 352. As explained in more detail in connection with FIGS. 4A-4C, only port 351 is exposed on the rear side of rotor 204. Channel 352 is only visible in FIG. 3G because of the location of the cross-sectional plane.

Figure 3H:
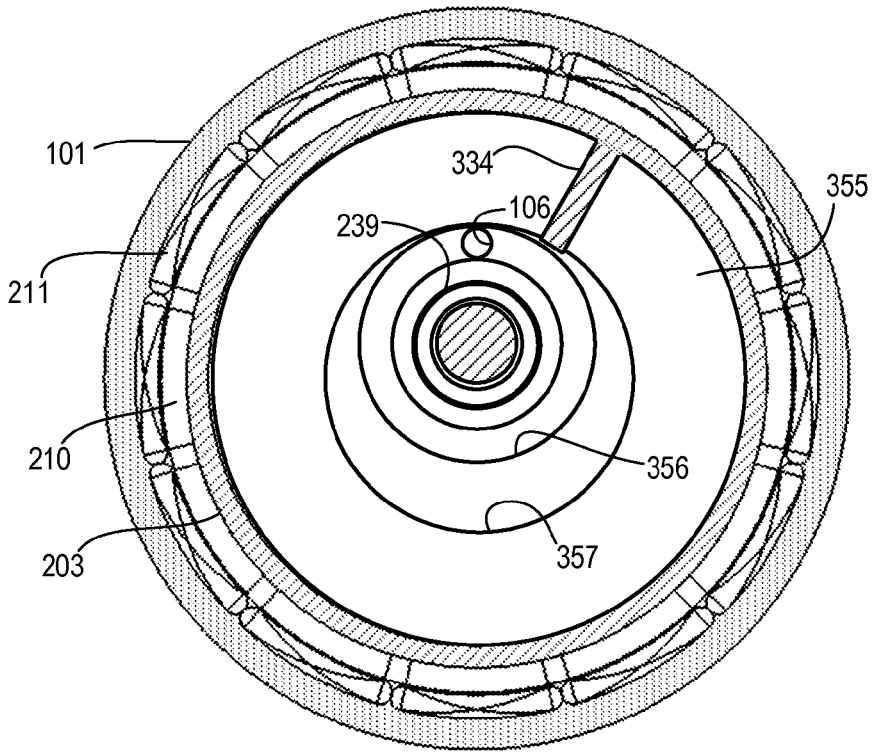

FIG. 3H is a cross-sectional view of engine 100 from the eighth location indicated in FIG. 2. The sectioning plane is positioned on the rear side of slotted rotor 204 and the view of FIG. 3H faces toward the rear of engine 100. Blade 334 is also fixed to an inner rear wall 355 of main rotor 203. An inner circumferential opening 357 in main rotor 203 exposes an inner face of housing 101 and several components located thereon. For example, seal 239 (discussed above) is visible. Also visible is an annular manifold 356 which connects to exhaust port 106 (FIG. 2).

Figure 4A:
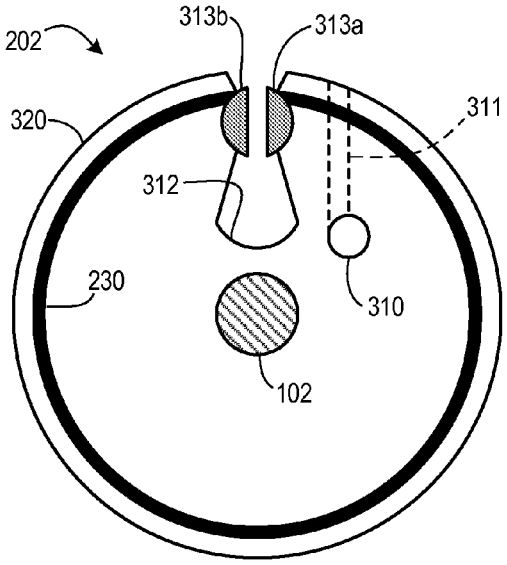
FIGS. 4A-4C are front, top and rear views, respectively, of the intake/compression slotted rotor of the engine and motor/generator of FIGS. 1A-1C.
Figure 4B:
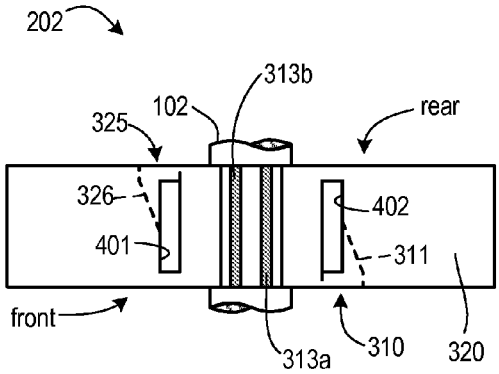
Figure 4C:
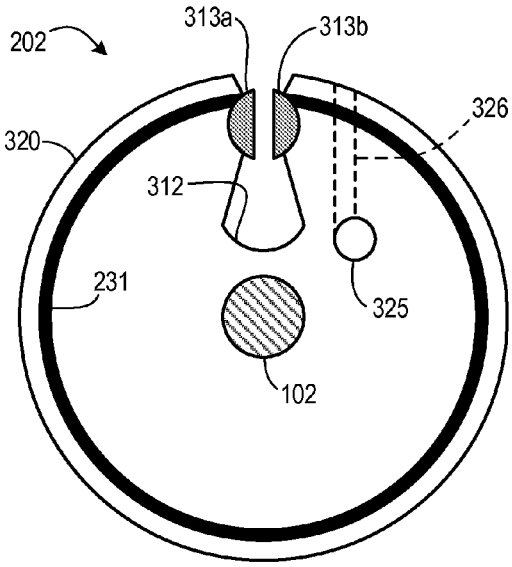

FIGS. 4A through 4C show slotted rotor 202 mounted onto shaft 102 but removed from engine 100. For convenience, rotor 202 is rotated approximately 30° from the positions shown in FIGS. 3B and 3C so as to place slot 312 at top dead center. FIG. 4A is a front view of rotor 202. Leaf seals 321 have been omitted from FIGS. 4A through 4C for convenience. In some embodiments, rotor 202 can be machined from a single piece of aluminum or other suitable material. Rotor 202 can be rotatably fixed relative to shaft 102 using a key (not shown), by machining splines in shaft 102 and corresponding grooves in the central hole of rotor 202 through which shaft 102 will extend, or using other suitable technique. Inlet port 310 is drilled into the front face of rotor 202 and intersects an internal channel 311. As seen in FIG. 4B, a top view of rotor 202 and shaft 102, channel 311 connects to a vent opening 402 in outer edge 320 of rotor 202. Thus, air received from a source at the front side of rotor 202 can be directed through inlet 310 and internal passage 311 and out of vent 402.

FIG. 4C is a rear view of rotor 202. Outlet port 325 is drilled into the rear face of rotor 202 and intersects an internal channel 326. As seen in FIG. 4B, channel 326 connects to a vent opening 401 in outer edge 320 of rotor 202. Thus, compressed air in a chamber bounded by outer edge 320 can be directed through vent 401 and internal passage 326 and out of outlet 325. As also seen in FIG. 4C, neither inlet 310 nor channel 311 is accessible from the rear face of rotor 202. Similarly, and as seen in FIG. 4A, neither outlet 325 nor channel 326 is accessible from the front face of rotor 202.

Figure 4D:
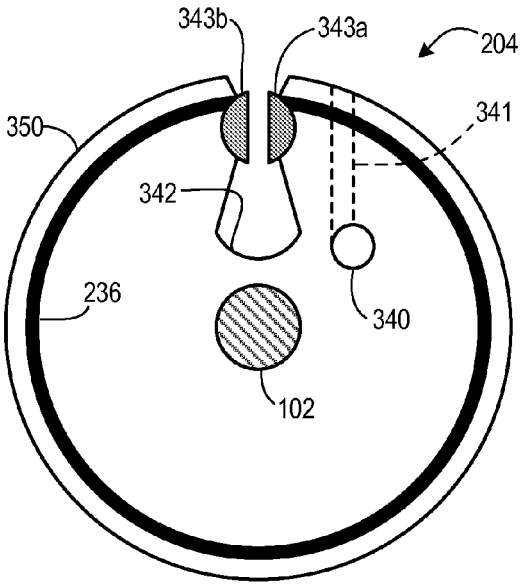
FIGS. 4D-4F are front, top and rear views, respectively, of the expansion/exhaust slotted rotor of the engine and motor/generator of FIGS. 1A-1C.
Figure 4E:
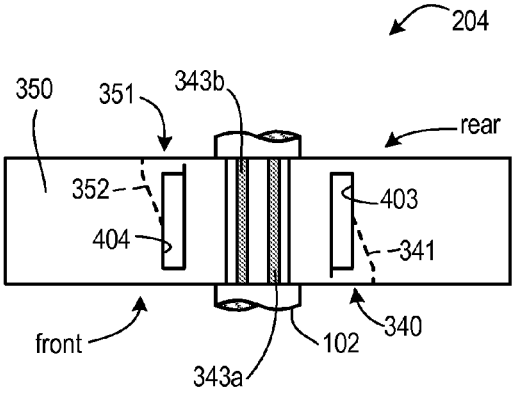
Figure 4F:
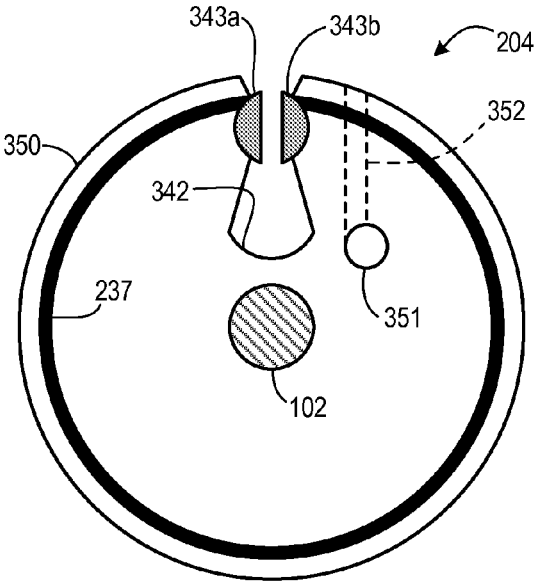

FIGS. 4D through 4F are front, top and rear views, respectively, of slotted rotor 204. Rotor 204 has also been rotated so as to place slot 342 at top dead center, and leaf seals 321 have been omitted for convenience. As can be appreciated by comparing FIGS. 4D through 4F with FIGS. 4A through 4C, slotted rotor 204 is similar to slotted rotor 202. Port 340 is drilled into the front face of rotor 204 and intersects an internal channel 341. Channel 341 connects to a vent opening 403 in outer edge 350 of rotor 204. Thus, compressed air and combustion products received from a source at the front side of rotor 204 can be directed through inlet 340 and internal passage 341 and out of vent 403. Outlet 351 intersects channel 352, and channel 352 connects to a vent opening 404 in outer edge 350. Thus, exhaust in an inter-rotor chamber bounded by outer edge 350 can be directed through vent 404 and internal passage 352 and out of outlet 351. Neither inlet 340 nor channel 341 is accessible from the rear face of rotor 204. Similarly, neither outlet 351 nor channel 352 is accessible from the front face of rotor 204.

Figure 5A:
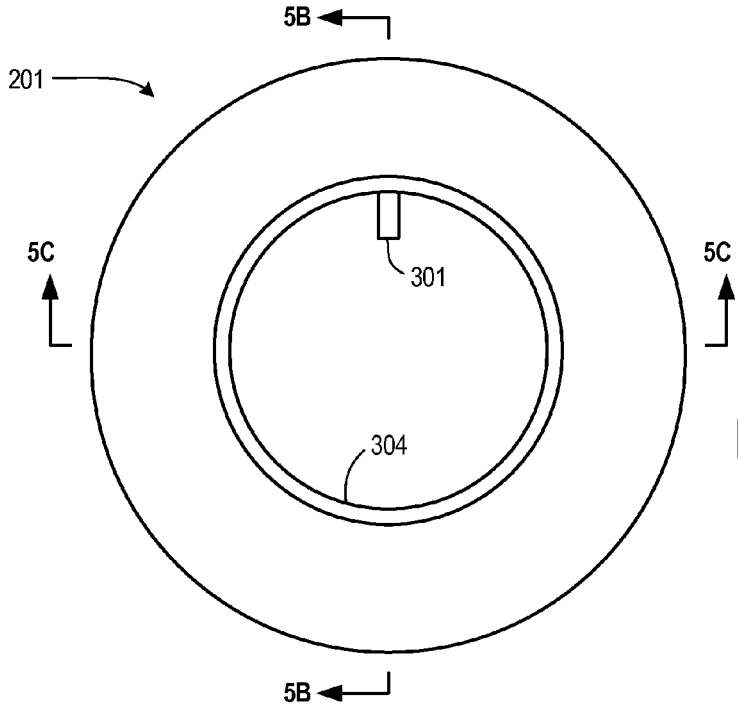
FIG. 5A is a front view of the intake/compression main rotor of the engine and motor/generator of FIGS. 1A-1C.
Figure 5B:
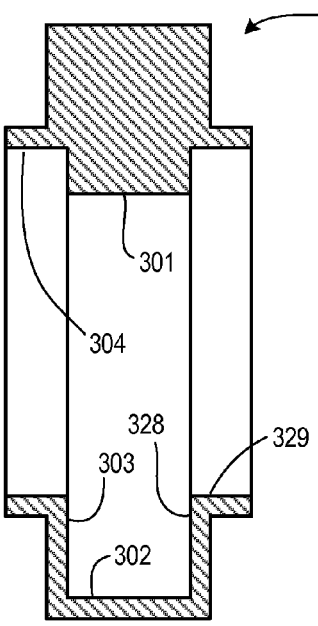
FIGS. 5B and 5C are cross-sectional views taken from the locations indicated in FIG. 5A.
Figure 5C:
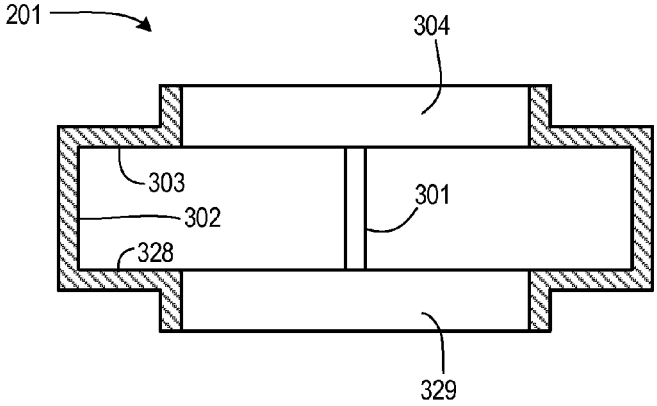

FIG. 5A is a front view of main rotor 201 removed from engine 100. FIG. 5B is a cross-sectional view of main rotor 201 from the location indicated in FIG. 5A. FIG. 5C is a different cross-sectional view of main rotor 201 from the second location indicated in FIG. 5A. For convenience, rotor 201 has been rotated approximately 30° from the position indicated in FIGS. 3A-3D so as to place blade 301 at top dead center. Rotors 201 and 203 can be formed from aluminum or other suitable material. As seen in FIG. 5A, blade 301 extends downward and is visible through opening 304. As seen in FIGS. 5B and 5C, blade 301 is attached to the inside of rotor 201 at inner perimeter wall 302, inner front wall 303 and inner rear wall 328.

Figure 5D:
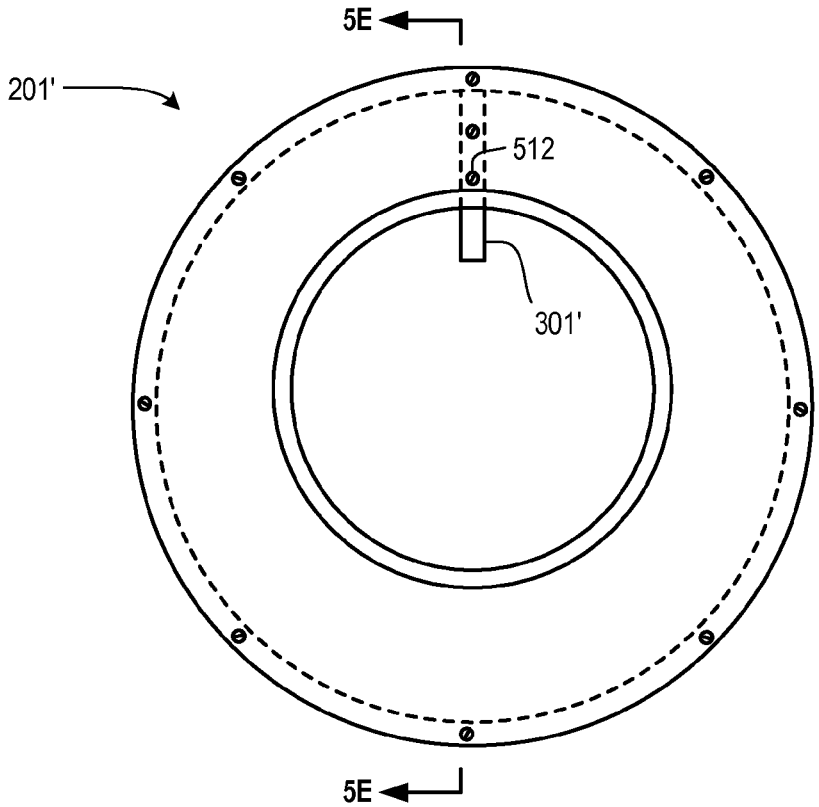
FIGS. 5D and 5E show a main rotor according to another embodiment.
Figure 5E:
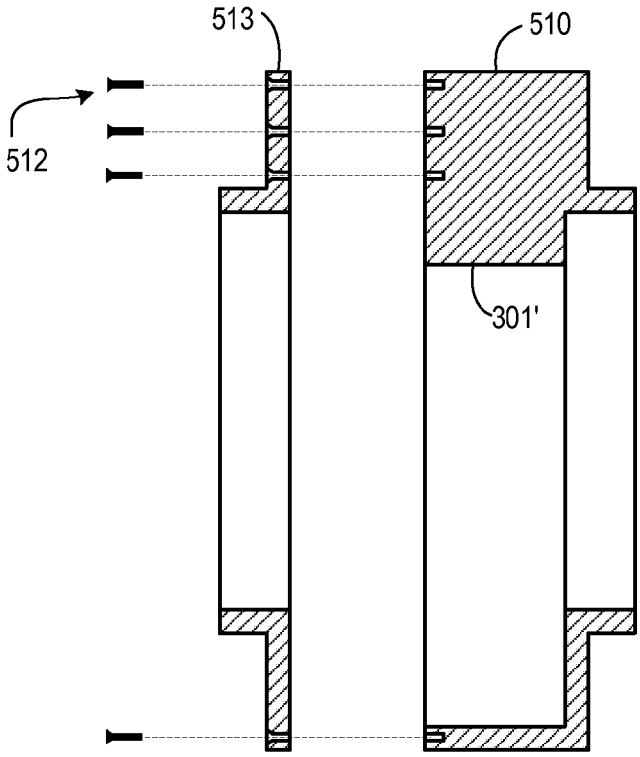

Although FIGS. 5A through 5C show rotor 201 as a monolithic element for simplicity, each of rotors 201 and 203 could be formed from two or more pieces that can be disassembled so as to allow insertion of a slotted rotor, and then reassembled so as to contain that slotted rotor. FIG. 5D shows a rotor 201' according to one such embodiment. FIG. 5E is an area cross-sectional view of rotor 201', from the location indicated in FIG. 5D, after disassembly. Rotor 201' is similar to rotor 201, except that rotor 201' comprises a front portion 513 and a rear portion 510 that are attached with fasteners (e.g., screws) 512. A gasket or other sealing compound could be placed between the adjoining surfaces of portions 510 and 513.

FIGS. 6A through 6F are partially schematic drawings showing relative positions of main rotor 201 and slotted rotor 202 at selected times during a complete revolution of rotors 201 and 202. During a complete intake/compression cycle, rotors 201 and 202 will make two complete rotations (i.e., each will rotate 720°). Stated differently, each intake/compression cycle includes two rotational cycles. The first half of each cycle is an intake half-cycle. During the intake half-cycle, air is drawn into a first inter-rotor chamber between rotors 201 and 202 during a first revolution (i.e., the first 360° of rotation). The second half of each intake/compression cycle is a compression half-cycle. During the compression half-cycle, which occurs during a rotation that immediately follows the rotation of the intake half-cycle (i.e., the second 360° of rotation), air is compressed in a second inter-rotor chamber between the rotors and then released into channel 242. Rotors 201 and 202 simultaneously perform two separate and overlapping intake/compression cycles as they rotate. During any given rotation, rotors 201 and 202 are performing the intake half-cycle of one intake/compression cycle and the compression half-cycle of a separate intake/compression cycle. This arrangement provides one power stroke for each 360° of rotation of the rotors.

Each of FIGS. 6A through 6F is an area cross-sectional view of rotors 201 and 202 taken from a plane passing through the center of rotors 201 and 202 (i.e., halfway between planes 3B-3B and 3C-3C of FIG. 2). The view in each of FIGS. 6A through 6F is facing toward the rear of engine 100. Manifolds 305 and 330 respectively lie in planes forward and rear of the sectioning plane used for FIGS. 6A-6F. The locations of manifolds 305 and 330 in those other planes are projected onto the sectioning plane used for FIGS. 6A-6F with broken lines. So as to distinguish between manifolds 305 and 330, the projection of manifold 305 is shown with smaller broken lines.

Figure 6A:
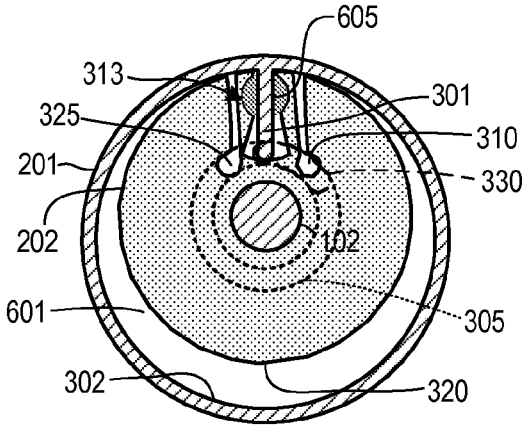
FIGS. 6A-6F are partially schematic drawings showing relative positions of the intake/compression slotted and main rotors of the engine and motor/generator of FIGS. 1A-1C at selected times during operation.

Each of rotors 201 and 202 rotates counterclockwise in FIGS. 6A-6F. Torque from shaft 102 rotates slotted rotor 202. The force of slotted rotor 202 against the side 605 of blade 301 rotates main rotor 201. In FIG. 6A, both of rotors 201 and 202 are at top dead center. Rotors 201 and 202 are about to begin the intake half-cycle of one intake/compression cycle and the compression half-cycle of a separate intake/compression cycle. An inter-rotor compression chamber 601 has a volume defined by inner perimeter wall 302 of rotor 201, by outer face 320 of rotor 202, and by portions of front inner wall 303 and rear inner wall 328 of rotor 202. Chamber 601 contains air that was drawn through manifold 305, inlet 310 and channel 311 during an intake half-cycle that occurred in the immediately preceding revolution of rotors 201 and 202.

Figure 6B:
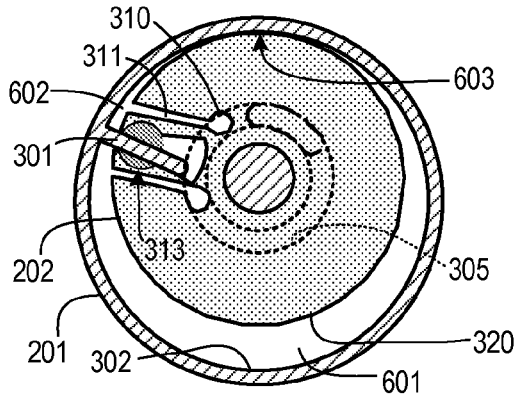

In FIG. 6B, rotor 202 has rotated clockwise. Main rotor 201 has also rotated in response to the rotation of rotor 202.

Trunnion seal 313 has rotated slightly clockwise and blade 301 has withdrawn slightly from seal 313. The volume of compression chamber 601 is reduced. Specifically, chamber 601 is bounded on one end by blade 301 and at the other end by an inter-rotor seal 603 resulting from the rolling contact (e.g., tangent or near tangent contact) between outer face 320 of rotor 202 and inner wall 302 of rotor 201. As rotors 201 and 202 rotate, the ends of chamber 601 become closer and the volume of chamber 601 is thus reduced. The reduction of volume in chamber 601 compresses air contained in chamber 601.

For convenience, the position of seal 603 is shown at the twelve o'clock position in FIGS. 6A-6F. In actuality, the precise position of seal 603 may be slightly to the right and/or left of the twelve o'clock position and will vary slightly as various of seals 321 approach and recede from the twelve o'clock position. Seals 321 are discussed below in connection with FIG. 8.

As also shown in FIG. 6B, separate inter-rotor intake chamber 602 is created as rotors 201 and 202 rotate past top dead center. The volume of chamber 602 is also bounded by blade 301 and by the inter-rotor seal 603. As rotors 201 and 202 rotate, the ends of chamber 602 become more separated and the volume of chamber 602 expands. Inlet 310 coincides with manifold 305 throughout an entire rotation of rotor 202. Accordingly, fresh air can flow from inlet 305 (FIG. 2), through inlet 310 and channel 311, and into intake chamber 602 as the volume of chamber 602 expands.

Figure 6C:
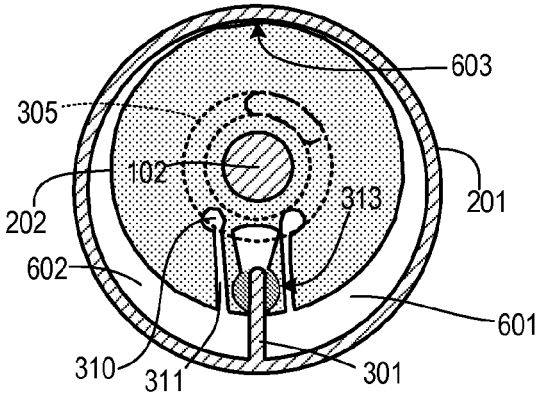

In FIG. 6C, rotors 201 and 202 have both rotated 180° from top dead center. Intake chamber 602 has continued to expand and draw in fresh air through manifold 305, inlet 310 and channel 311. Compression chamber 601 has continued to contract, resulting in further compression of the air contained therein. Seal 313 has rotated clockwise so as to be in the same position (relative to slotted rotor 202) as is shown in FIG. 6A. Blade 301 has reached the point of maximum withdrawal from slot 312 (see FIG. 4A).

Figure 6D:
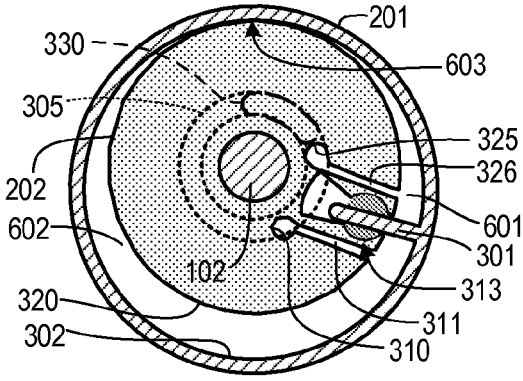

In FIG. 6D, rotors 201 and 202 have rotated further. Intake chamber 602 has continued to expand and draw in fresh air through manifold 305, inlet 310 and channel 311. Compression chamber 601 has continued to contract and compress air contained therein. Seal 313 has now rotated slightly counter-clockwise, and blade 310 has begun to re-enter slot 315. As also seen in FIG. 6D, outlet 325 is nearing the beginning of its coincidence with manifold 330.

Figure 6E:
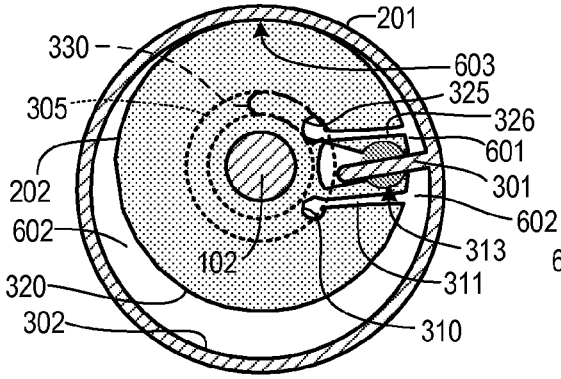

FIG. 6E shows rotors 201 and 202 rotated to the point at which outlet 325 begins to coincide with manifold 330. Because of this coincidence, compressed air in chamber 601 can more easily flow through channel 326 and outlet 325 into manifold 330, and from manifold 330 into compressed air channel 242 (see FIG. 2). Intake chamber 602 has continued to expand and draw in fresh air through manifold 305, inlet 310 and channel 311.

At this point in the rotation of rotors 201 and 202, a valve in chamber 243 (FIG. 2) opens and allows compressed air to flow from channel 242, chamber 243 and channel 244 into an expansion inter-rotor chamber of rotors 203 and 204. This expansion and the operation of rotors 203 and 204 are further discussed below in connection with FIGS. 7A-7F. The opening and closing of the valve within chamber 243, which valve could be a rotary valve or other type of valve, can be timed to the rotation of rotors 201 and 202 (and/or to the rotation of rotors 203 and 204) by mechanical coupling to shaft 102 or to another rotating component, by gears, by a timing belt, by a camshaft, by an electrically controlled servomotor, or by other mechanism.

Figure 6F:
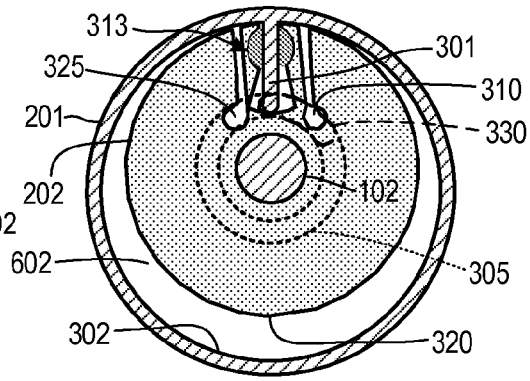

FIG. 6F shows rotors 201 and 202 after they have completed the revolution begun in FIG. 6A. The intake/compression cycle for which the compression half-cycle began in FIG. 6A has now completed. The intake/compression cycle for which the intake half-cycle began in FIG. 6A has now completed its intake half-cycle and is about to begin its compression half-cycle. In particular, as rotors 201 and 202 again rotate through top dead center, chamber 602 will become a compression chamber. A new inter-rotor intake chamber will also be formed and will draw in fresh air as part of the intake half-cycle of a new intake compression cycle.

FIGS. 7A through 7F are partially schematic drawings showing relative positions of main rotor 203 and slotted rotor 204 at selected times during a complete revolution of rotors 203 and 204. During a complete expansion/exhaust cycle, rotors 203 and 204 will also make two complete rotations (i.e., each will rotate 720°). Stated differently, each expansion/exhaust cycle includes two rotational cycles. The first half of each expansion/exhaust cycle is an expansion half-cycle. During the expansion half-cycle, compressed air and combustion products are blown into a first inter-rotor chamber between rotors 203 and 204 during a first revolution (i.e., the first 360° of rotation). The second half of each expansion/exhaust cycle is an exhaust half-cycle. During the exhaust half-cycle, which occurs during a rotation that immediately follows the rotation of the expansion half-cycle (i.e., the second 360° of rotation), exhaust in a second inter-rotor chamber between the rotors is scavenged and forced out through exhaust port 106. Rotors 203 and 204 simultaneously perform two separate and overlapping expansion/exhaust cycles as they rotate. During any given rotation, rotors 203 and 204 are performing the expansion half-cycle of one expansion/exhaust cycle and the exhaust half-cycle of a separate expansion/exhaust cycle.

The simultaneous and overlapping expansion/exhaust cycles in rotors 203 and 204 occur while simultaneous and overlapping intake/compression cycles occur in rotors 201 and 202. However, a respective correspondence between FIGS. 6A-6F and 7A-7F is not necessarily intended. In other words, the rotational phase of rotors 203 and 204 represented in one of FIGS. 7A-7F ending with a particular capital letter may or not be the rotational phase that rotors 203 and 204 would have when rotors 201 and 202 have the rotational phase represented in the one of FIGS. 6A-6F ending with the same capital letter.

Each of FIGS. 7A through 7F is an area cross-sectional view of rotors 203 and 204 taken from a plane passing through the center of rotors 203 and 204 (i.e., halfway between planes 3F-3F and 3G-3G of FIG. 2). The view in each of FIGS. 7A through 7F is facing toward the rear of engine 100. Manifolds 336 and 356 respectively lie in planes forward and rear of the sectioning plane used for FIGS. 7A-7F. The locations of manifolds 336 and 356 in those other planes are projected onto the sectioning plane used for FIGS. 7A-7F with broken lines. So as to distinguish between manifolds 336 and 356, the projection of manifold 356 is shown with smaller broken lines.

Figure 7A:
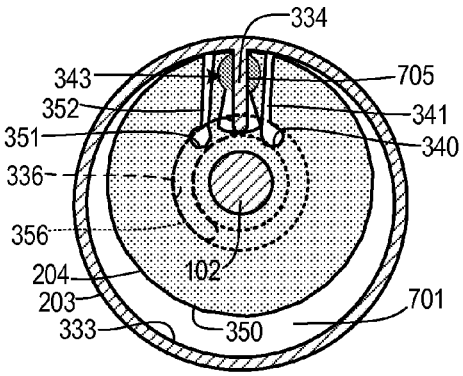
FIGS. 7A-7F are partially schematic drawings showing relative positions of the expansion/exhaust slotted and main rotors of the engine and motor/generator of FIGS. 1A-1C at selected times during operation.

In FIG. 7A, both of rotors 203 and 204 are at top dead center. Rotors 203 and 204 are about to begin the expansion half-cycle of one expansion/exhaust cycle and the exhaust half-cycle of a separate expansion/exhaust cycle. The volume of an inter-rotor exhaust chamber 701 is defined by inner perimeter wall 333 of rotor 203, by outer face 350 of rotor 204, and by portions of front inner wall 337 and rear inner wall 355 of rotor 204. Chamber 701 contains exhaust that remains after compressed air and combustion products were forced through manifold 336, inlet 340 and channel 341 during the preceding revolution.

Figure 7B:
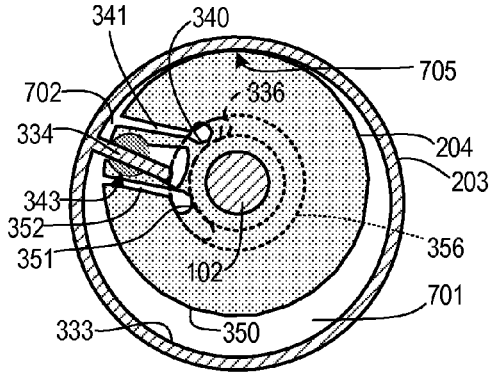

In FIG. 7B, rotors 203 and 204 have rotated clockwise as a result of the momentum from the previous revolution. Because of the rotation from top dead center, inlet 340 and manifold 336 coincide. Trunnion seal 343 has rotated slightly clockwise and blade 334 has withdrawn slightly from seal 343. An inter-rotor expansion chamber 702 has also been created. The volume of chamber 702 is bounded at one end by blade 334 and at the other end by an inter-rotor seal 705 resulting from the rolling contact between outer face 350 of rotor 204 and inner wall 333 of rotor 203. As with inter-rotor seal 603 discussed in connection with FIGS. 6B-6E, the position of seal 705 is for convenience shown at the twelve o'clock position in FIGS. 7B-7E. In actuality, the precise position of seal 705 will be slightly to the left and/or right of the twelve o'clock position and will vary slightly as various of seals 321 approach and recede from the twelve o'clock position.

Because inlet 340 and manifold 336 coincide, heated and compressed gas (air and combustion products) can easily flow from combustion chamber 243, through channel 244, manifold 336, inlet 340, channel 341 and vent opening 403, and into expansion chamber 702. The expansive pressure of this heated and compressed gas causes chamber 702 to further expand. In particular, the expansive pressure pushes blade 334 away from seal 705 so as to create more volume to accommodate the expanding gas. The resulting force causes rotors 203 and 204 to continue rotating.

As expansion chamber 702 expands, exhaust chamber 701 contracts. This contraction scavenges exhaust gases that remain from a previous expansion half-cycle (during the previous revolution) and pushes those scavenged exhaust gases through vent 404, channel 352, outlet 351, manifold 356 and exhaust port 106.

Figure 7C:
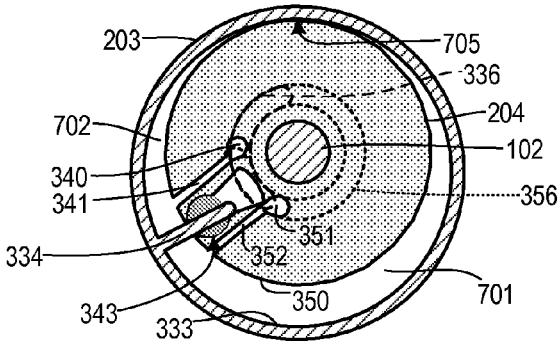

In FIG. 7C, inlet 340 still coincides with manifold 336, and expanding gases continue to flow into chamber 702. The resulting continued expansion of the chamber 702 volume continues to impart rotational forces on rotors 203 and 204. Chamber 701 continues to contract, thereby continuing the scavenging and evacuation of exhaust gases. Seal 343 is still rotated clockwise, and blade 334 has withdrawn further from slot 342.

Figure 7D:
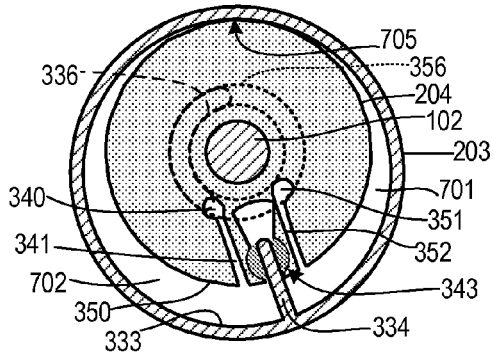
Figure 7E:
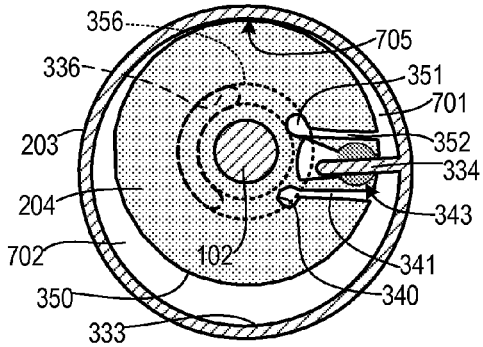

In FIGS. 7D and 7E, rotors 203 and 204 have continued to rotate in response to expanding gases in chamber 702. Exhaust chamber 701 has continued to contract and scavenge exhaust. Seal 343 has rotated counterclockwise and blade 334 has begun re-entry into slot 342 (see FIG. 4D).

Figure 7F:
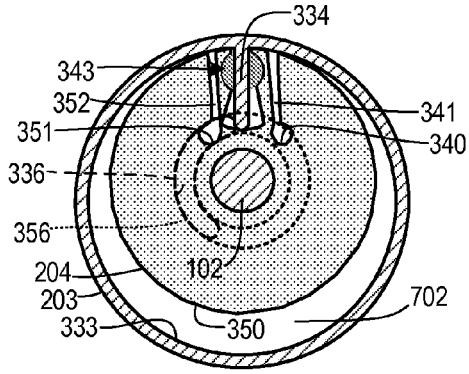

FIG. 7F shows rotors 203 and 204 after they have completed the revolution begun in FIG. 7A. The expansion/exhaust cycle for which the exhaust half-cycle began in FIG. 7A has now completed. The expansion/exhaust cycle for which the expansion half-cycle began in FIG. 7A has now completed its expansion half-cycle and is about to begin its exhaust half-cycle. In particular, as rotors 203 and 204 again rotate through top dead center, inter-rotor chamber 702 will become an exhaust chamber. A new inter-rotor expansion chamber will also be formed and will receive a new injection of heated and compressed gas from combustion chamber 243 as part of the expansion half-cycle of a new expansion/exhaust cycle.

Figure 8A:
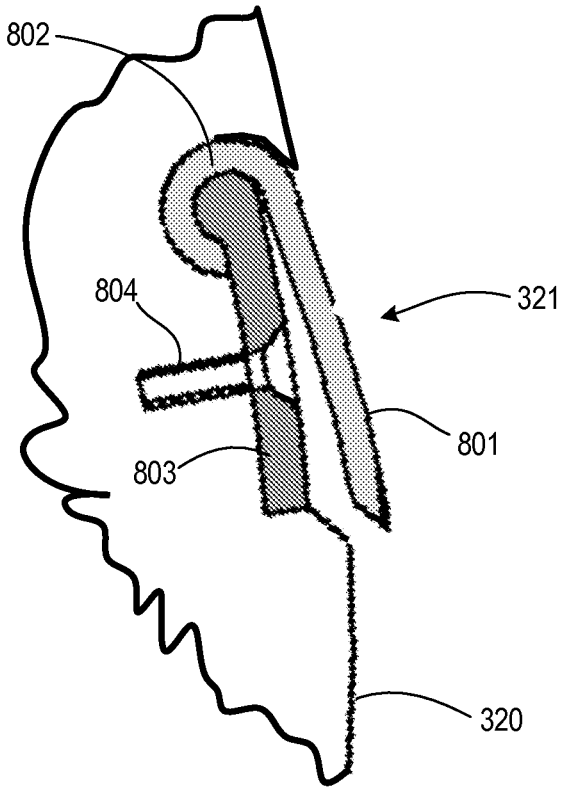
FIGS. 8A and 8B show a limited radial extension swing seal.

FIG. 8A is an enlarged view from the location indicated in FIG. 3B and shows additional details of a leaf seal 321. Seal 321 extends across the entire width of outer surface 320 of rotor 202. Seal 321 includes a flexible leaf element 801 that is biased away from outer surface 320. A base end 802 of leaf element 801 is held in place by a bracket 803, with bracket 803 secured to rotor 202 using one or more fasteners 804. Bracket 803 and fastener(s) 804 are sufficiently recessed so that leaf element 801 lies flush (or nearly flush) with surface 320 as surface 320 rolls relative to inner circumferential surface 302 of rotor 201.

Figure 8B:
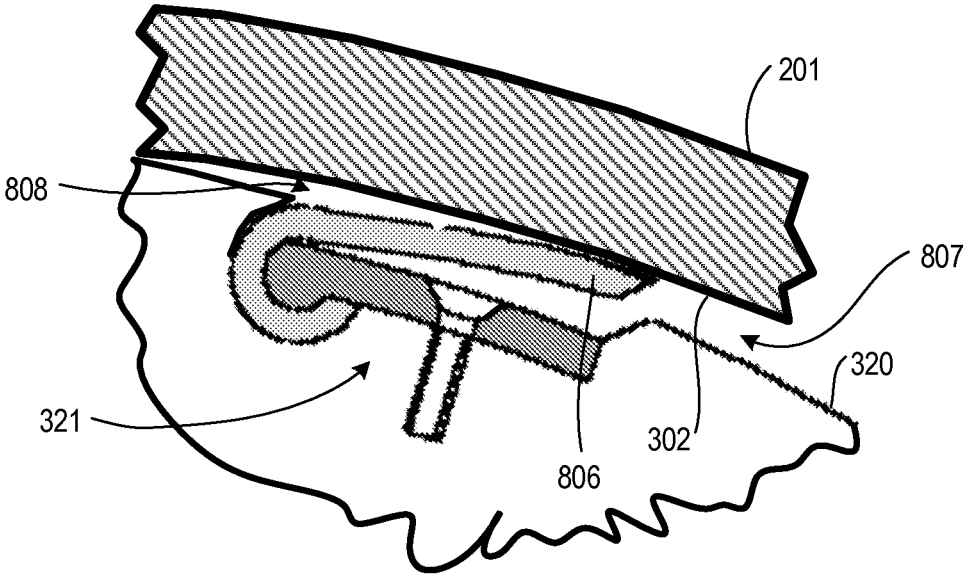

FIG. 8B is similar to FIG. 8A, but shows a seal 321 after the relative rotation of rotors 201 and 202 has brought seal 321 near the point at which the rotors will be in rolling contact. The free end 806 of leaf element 801 is forced against wall 302 of rotor 201. This creates a seal that prevents flow of gases from side 807 to side 808.

Rotor 204 similarly has a plurality of leaf seals 321 that operate similar to the seals 321 of rotor 202. In some embodiments, a rotor has at least five seals 321, with each of those five seals and the center of the slot having radially even positions. In particular, the radius from rotor centerline through the slot center is N*60° for each of the radii passing through the centers of seals 321, where N=1, 2, 3, 4, or 5. Additional seals 321 could be included. Leaf element 801 could be formed from a nickel-based or cobalt alloy material, and could be ribbon shim stock coated with low friction diamond-like carbon or other coatings of the rolling contact surface. The leaf element could be hinged or rigidly affixed to the slotted rotor.

Figure 8C:
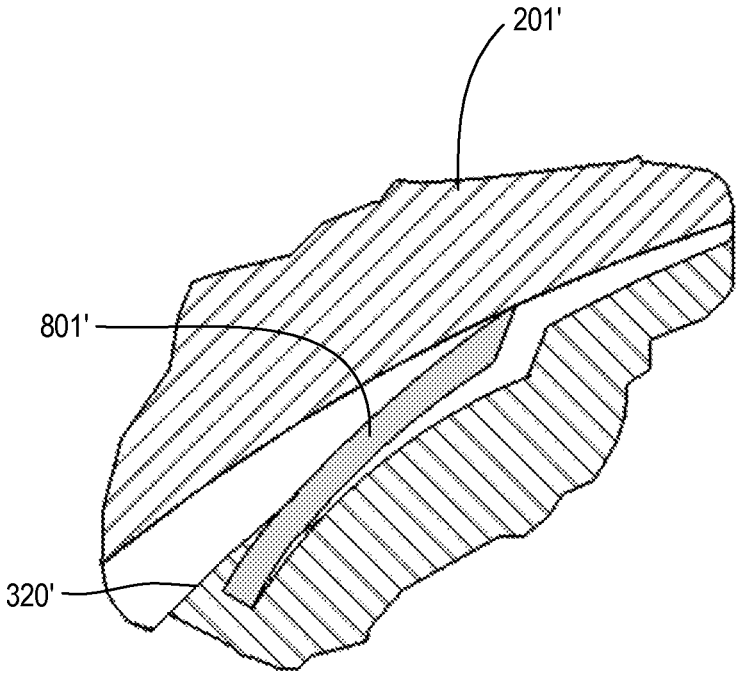
FIG. 8C shows a limited radial extension swing seal according to another embodiment.

FIG. 8C shows a leaf element 801' according to another embodiment. FIG. 8C shows element 801' just after the portion of surface 320' into which element 801' is inserted has rolled past the point of rolling contact with the inner perimeter surface of a main rotor 201'. Surface 320' could be a surface of a slotted rotor similar to rotor 202. Rotor 201' could be similar to rotor 201. Element 801' could be formed from materials similar to those usable for element 801.

Figure 9C:
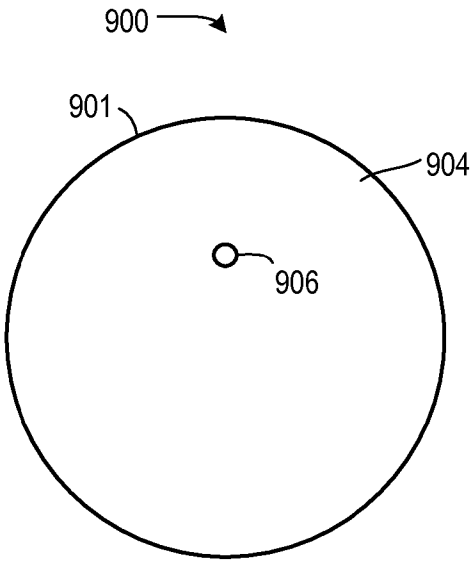
FIGS. 9A-9C are front, side and rear views, respectively, of a combination rotary engine and motor/generator according to certain additional embodiments.
Figure 9B:
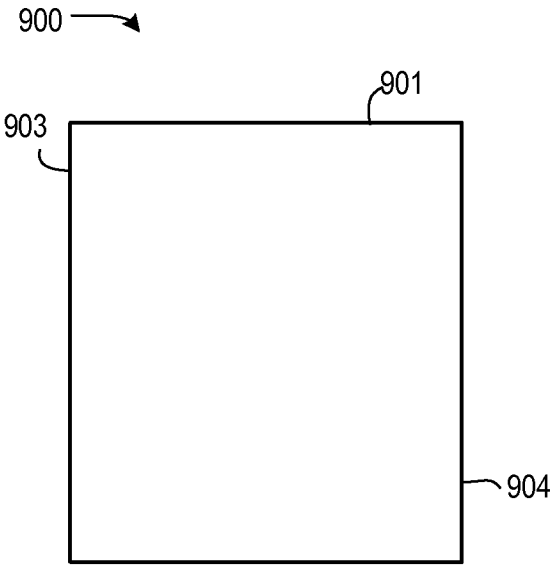
Figure 9A:
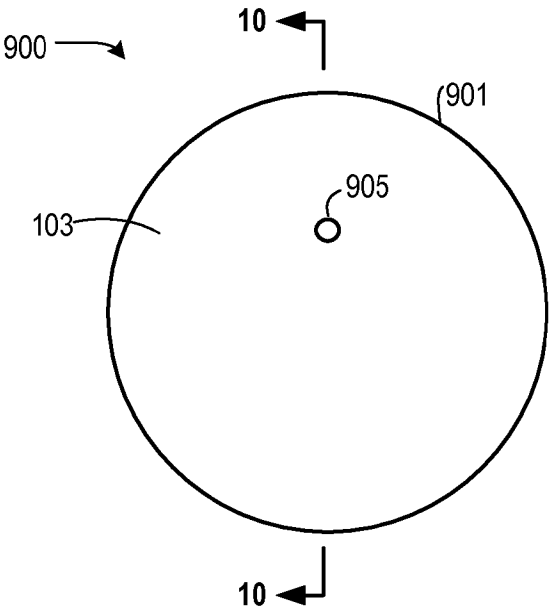

Shaft 102 of engine 100 can be coupled to a pump, a turbocharger or another device and used to provide mechanical power to that coupled device. Power from shaft 102 could also or alternatively be coupled to a transmission and used to provide motive power. In other embodiments, an engine may not include a shaft. For example, FIGS. 9A-9C are front, side and rear views, respectively, of a combination rotary engine and motor/generator 900 according to another embodiment. Similar to engine 100, engine 900 includes a housing 901, an air intake port 905 located in a front face 903, and an exhaust port 906 located in a rear face 904. Unlike engine 100, however, engine 900 does not include an external shaft. Engine 900 could, e.g., be used solely to generate electrical power. As with FIGS. 1A-1C, FIGS. 9A-9C do not show various elements such as fuel line connections, wiring harness connections, etc.

Figure 10:
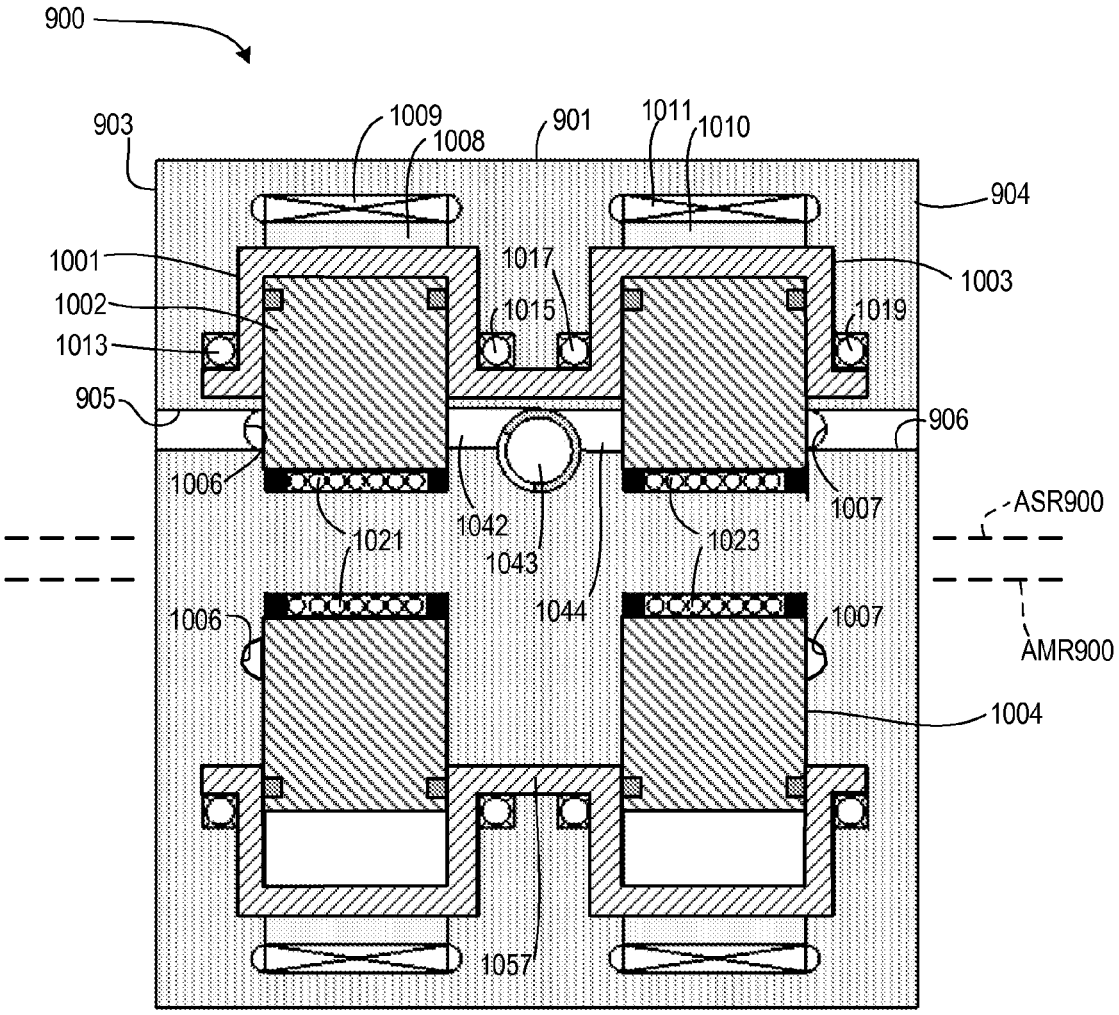
FIG. 10 is a cross-sectional view take from the location indicated in FIG. 9A.

FIG. 10 is a cross-sectional view of engine 900 from the location indicated in FIG. 9A. Engine 900 includes an intake/compression main rotor 1001 and an intake/compression slotted rotor 1002. The rear portion of engine 900 includes an expansion/exhaust main rotor 1003 and an expansion/exhaust slotted rotor 1004. Each of main rotors 1001 and 1003 rotates about a main rotor axis AMR900. Each of slotted rotors 1002 and 1004 rotates about a slotted rotor axis ASR900. Unlike rotors 202 and 204 of engine 100, however, rotors 1002 and 1004 are not attached to an axle. Rotor 1002 is rotatably supported by bearings 1021 and rotor 1004 is rotatably supported by bearings 1023. Rotors 1001 and 1003 are connected to one another by a flange 1057, which connection coordinates the rotation of the rotor sets in engine 900.

Rotors 1001 and 1003 are rotatably supported by bearings 1013, 1015, 1017 and 1019. An armature 1008 is attached to rotor 1001 and rotates within a stator 1009. An armature 1010 is attached to rotor 1003 and rotates within a stator 1011.

Intake 905 supplies air to a manifold 1006 that is similar to manifold 305 of engine 100. Rotor 1001 is similar to rotor 201 of engine 100. Other than being rotatably mounted solely on bearings 1021 instead of an axle, rotor 1002 is similar to rotor 202 of engine 100 and has similar ports, channels, leaf seals, etc. Compressed air from rotors 1001 and 1002 is output to a manifold (not shown) that is similar to manifold 330 of engine 100, which compressed air flows through a channel 1042 to a combustion chamber 1043 similar to combustion chamber 242. Heated compressed gases (air and combustion products) flow from chamber 1043 through channel 1044 to a manifold (not shown) similar to manifold 336.

Rotor 1003 is similar to rotor 203 of engine 100. Other than being rotatably mounted solely on bearings 1023 instead of an axle, rotor 1004 is similar to rotor 204 of engine 100 and has similar ports, channels, leaf seals, etc. Heated compressed gases enter rotor 1004 in a manner similar to that of rotor 204 and cause rotors 1003 and 1004 to rotate. Exhaust is scavenged from rotors 1003 and 1004, in a manner similar to that described in connection with rotors 203 and 204, and forced out through a manifold 1007 (similar to manifold 356) and exhaust port 906.

Other embodiments include numerous additional variations. As but one example, channels such as channels 311 and 352 need not be formed in the manner shown in connection with engine 100. In some embodiments, an intake channel could be formed as a groove in the front face of the intake/compression slotted rotor and the exhaust channel could be formed as a groove in the rear face of the expansion/exhaust slotted rotor.

Figures 11A, 11B, 11C:
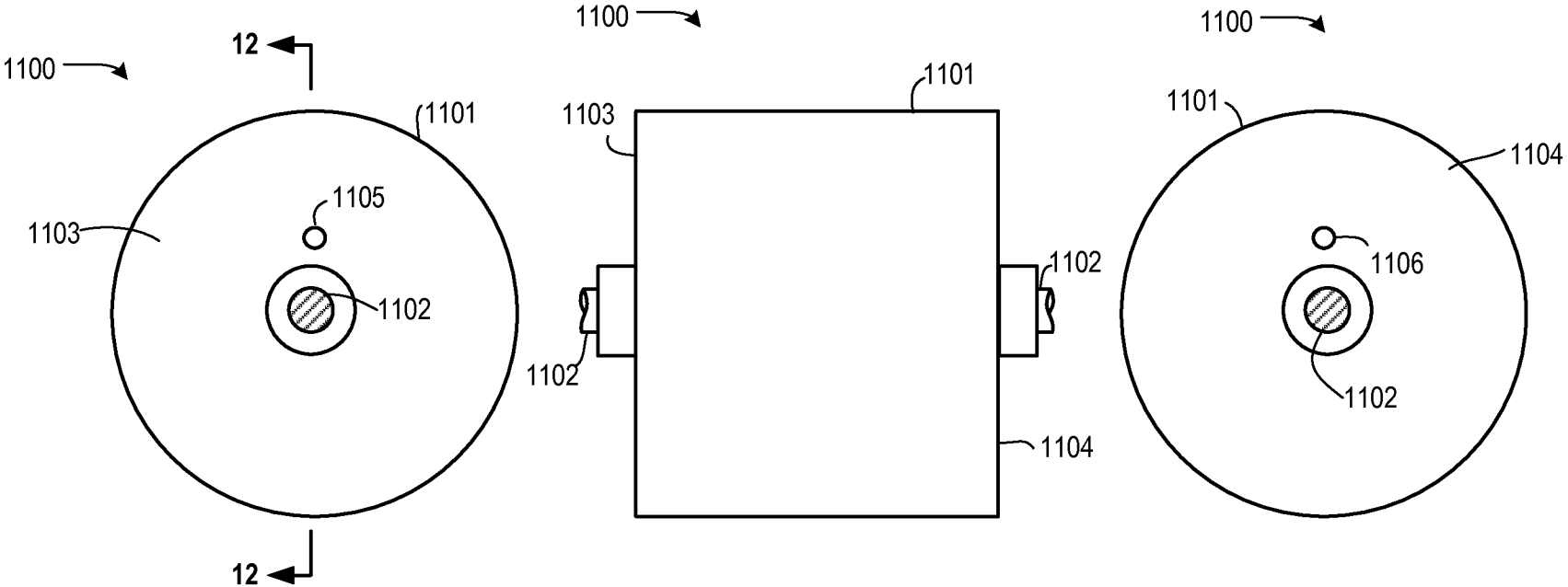
FIGS. 11A-11C are front, side and rear views, respectively, of a combination rotary engine and motor/generator according to certain additional embodiments.

In still other embodiments, the main rotors in a combination rotary engine and motor/generator are attached to a shaft. FIGS. 11A-11C are front, side and rear views, respectively, of a combination rotary engine and motor/generator 1100 according to one such embodiment. Similar to engines 100 and 900, engine 1100 includes a housing 1101, an air intake port 1105 located in a front face 1103, and an exhaust port 1106 located in a rear face 1104. A shaft 1102 extends through front and rear faces 1103 and 1104 and is coupled to main rotors within engine 1100. As with previously-described embodiments, FIGS. 11A-11C do not show various elements such as fuel line connections, coolant line connections, wiring harness connections, etc.

Figure 12:
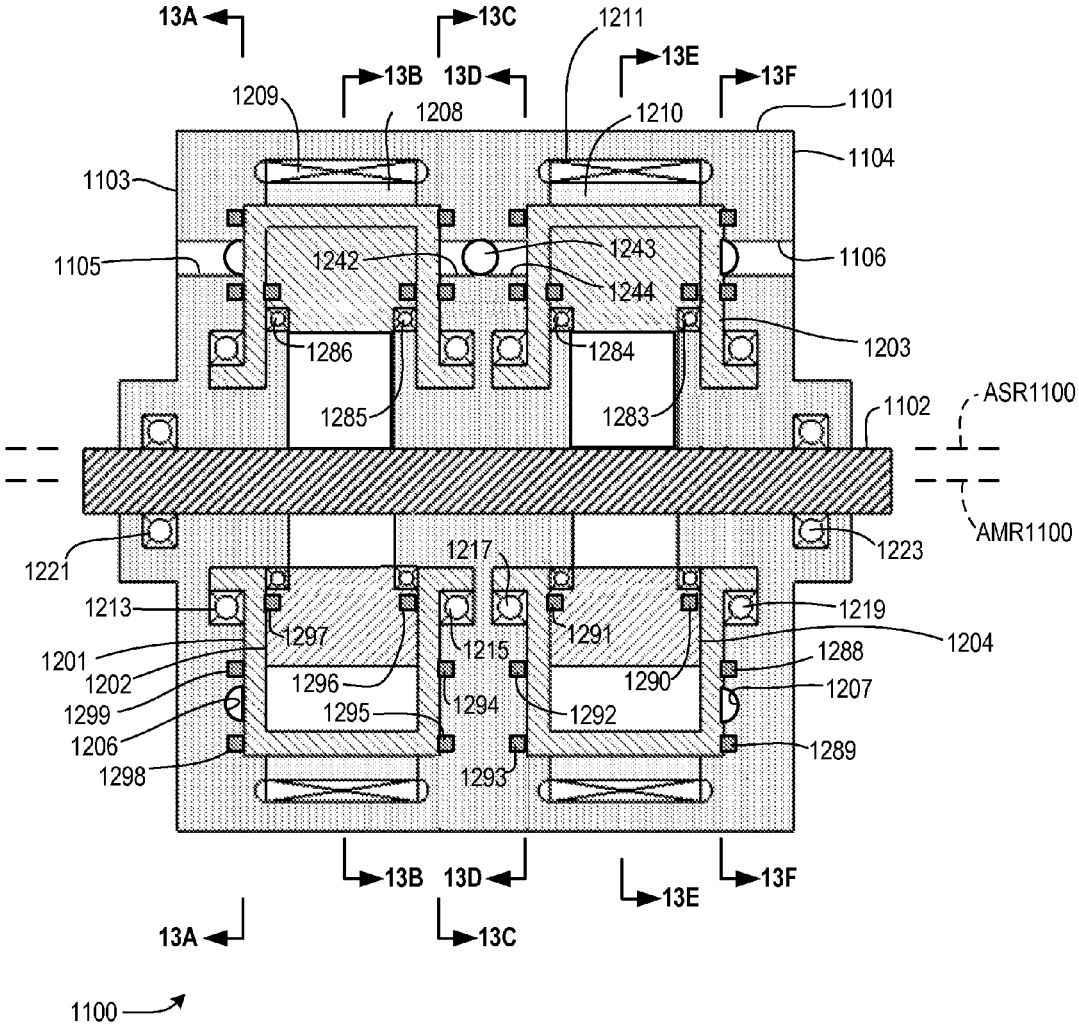
FIG. 12 is a cross-sectional view taken from the location indicated in FIG. 11A.

FIG. 12 is a cross-sectional view of engine 1100 from the location indicated in FIG. 11A. The front portion of engine 1100 includes an intake/compression main rotor 1201 and an intake/compression slotted rotor 1202. The rear portion of engine 1100 includes an expansion/exhaust main rotor 1203 and an expansion/exhaust slotted rotor 1204. Each of main rotors 1201 and 1203 is connected to shaft 1102 by a blade, as described in more detail in connection with FIGS. 13A and 13E. Shaft 1102 is rotatably supported by bearings 1221 and 1223. Main rotor 1201 is rotatably supported by bearings 1213 and 1215. Main rotor 1203 is rotatably supported by bearings 1217 and 1219.

Slotted rotor 1202 is located within main rotor 1201 and is rotatably supported by bearings 1286 and 1285. Slotted rotor 1204 is located within main rotor 1203 and is rotatably supported by bearings 1284 and 1283. Slotted rotors 1202 and 1204 rotate about an axis ASR1100. Main rotors 1201 and 1203, as well as shaft 1102, rotate about an axis AMR1100.

Fresh air is drawn in through intake 1105 and is supplied to a circular manifold 1206. An opening in the forward face of main rotor 1201, which opening is described in connection with FIG. 14A, allows fresh air to flow into an inter-rotor intake chamber created between rotors 1201 and 1202. As an inter-rotor compression chamber between rotors 1201 and 1202 compresses that air, a slot in the rear wall of main rotor 1201 (described in connection with FIG. 14C) allows that compressed air to flow into a compressed air channel 1242. Channel 1242 feeds into a combustion chamber/valve 1243. Fuel is also added in chamber 1243. After that fuel and compressed air mixture is ignited, the valve of chamber 1243 allows the resulting heated and compressed gas to flow through channel 1244.

Channel 1244 connects to an arcuate manifold in a wall of housing 1101 that adjoins the front face of main rotor 1203. That arcuate manifold is shown in FIG. 13D. An opening in the front face of main rotor 1203 allows that heated and compressed gas to enter an inter-rotor expansion chamber between rotors 1203 and 1204. As that gas expands, the resulting force causes rotors 1203 and 1204 to rotate. After the gases expand, the exhaust is scavenged in an inter-rotor exhaust chamber formed by rotors 1203 and 1204 and then forced out through a circular manifold 1207 and exhaust port 106.

Ring seals 1298 and 1299 are located in a wall of housing 1101 that faces the front of main rotor 1201. Seals 1298 and 1299 help ensure that only fresh air from intake 1105 is supplied to manifold 1206. Ring seals 1295 and 1294 are located in a wall of housing 1101 that faces the rear of main rotor 1201. Seals 1295 and 1294 help to contain air compressed between rotors 1201 and 1202 so as to prevent that compressed air from leaking into portions of housing 1101 other than channel 1242. Ring seal 1297 in the front of slotted rotor 1202 and ring seal 1296 in the rear of slotted rotor 1202 help prevent compressed air from leaking out of a compression chamber formed by rotors 1201 and 1202.

Ring seals 1293 and 1292 are located in a wall of housing 1101 that faces the front of main rotor 1203. Seals 1293 and 1292 help to contain heated and compressed gases flowing from channel 1244 so as to direct those gases into an inter-rotor expansion chamber between rotors 1203 and 1204. Ring seals 1289 and 1288 are located in the wall of housing 1101 that faces the rear of main rotor 1203. Seals 1289 and 1288 help to direct exhaust through port 1106. Ring seal 1291 in the front of slotted rotor 1204 and ring seal 1290 in the rear of slotted rotor 1204 help prevent expanding gasses from leaking out of an inter-rotor expansion chamber formed by rotors 1203 and 1204.

Figure 13A:
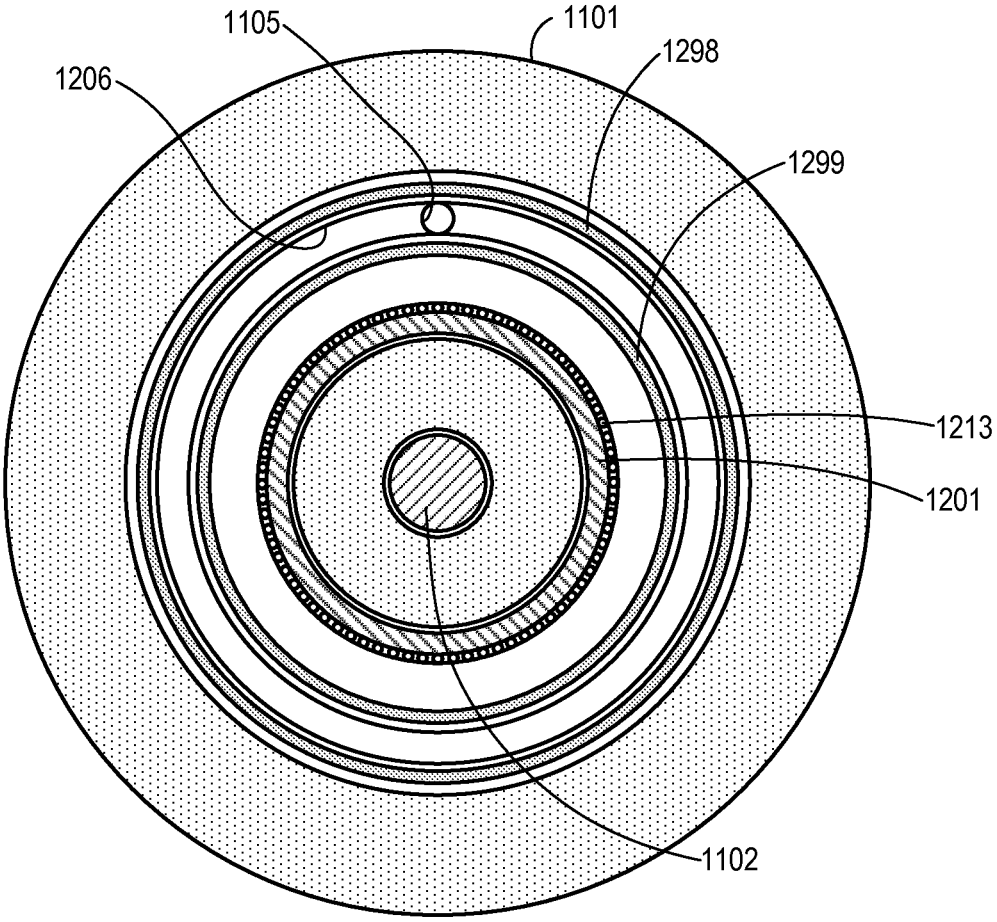
FIGS. 13A-13F are cross-sectional views taken from the locations indicated in FIG. 12.

FIG. 13A is a cross-sectional view taken from the first location indicated in FIG. 12. As seen more clearly in FIG. 13A, intake 1105 connects to manifold 1206. Manifold 1206 extends around the entire circumference of a portion of housing 1101 that faces the front of main rotor 1201. In some embodiments, a check valve could be located in intake 1105 to prevent backflow from rotors 1201 and 1202 from passing through intake 1105.

Figure 13B:
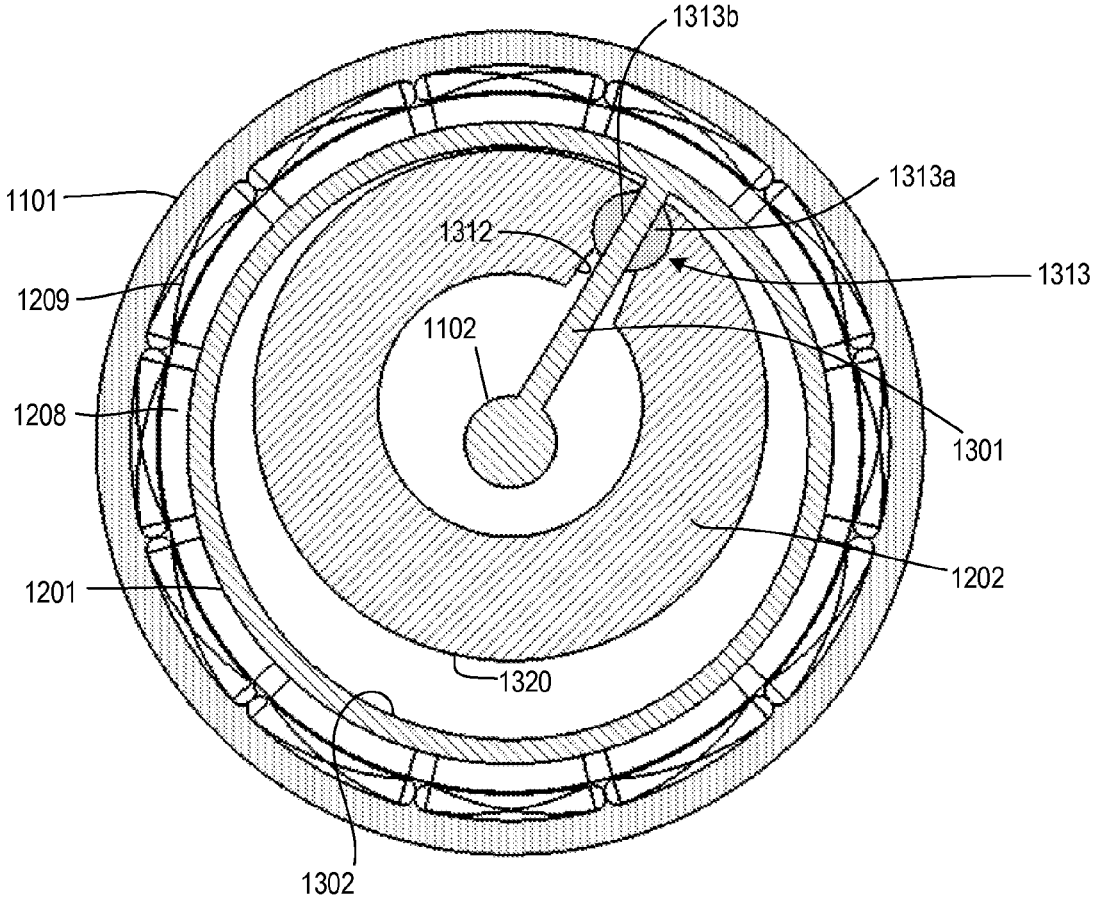

FIG. 13B is a cross-sectional view taken from second location indicated in FIG. 12. A blade 1301 connects the inner perimeter wall 1302 of main rotor 1201 to shaft 1102. Two halves 1313*a* and 1313*b* of a cylindrical split trunnion seal 1313 are contained in a slot 1312 of slotted rotor 1202. Blade 1301 slides between halves 1313*a* and 1313*b*, and seal 1313 can rotated within slot 1312. Seal 1313 operates similar to seal 313 described in connection with engine 100 and prevents gas from passing through slot 1312. As described below in connection with FIGS. 16A-16E, seal 1313 allows creation of intake and compression inter-rotor chambers between wall 1302 and outer surface 1320 of slotted rotor 1202. Although not shown, leaf seals similar to leaf seals 321 could be included in surface 1320.

Figure 13C:
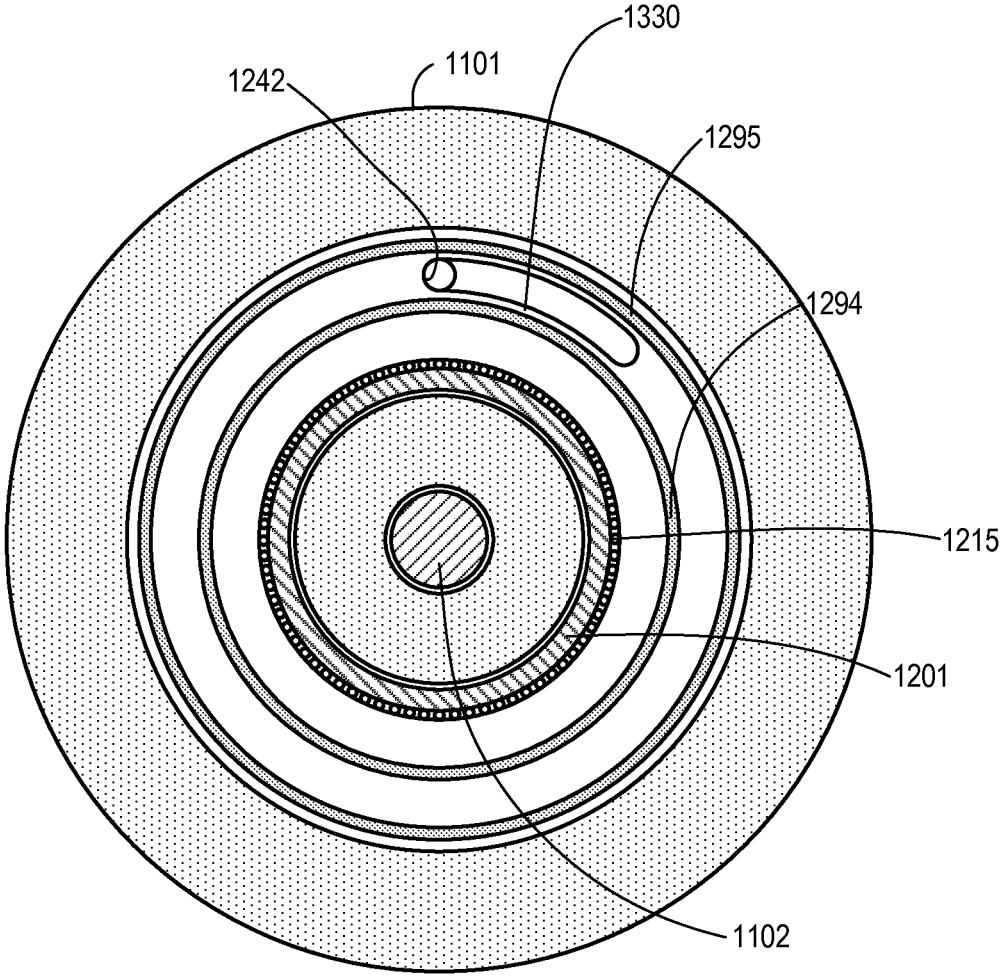
Figure 13D:
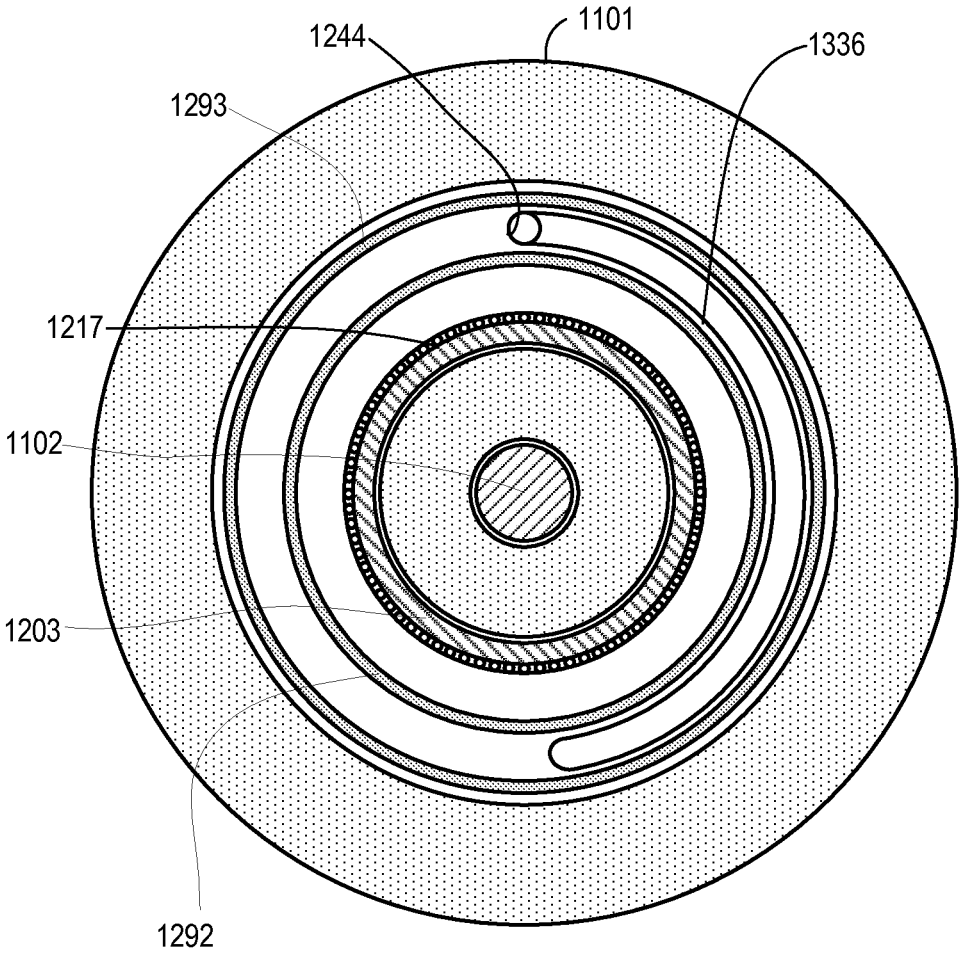

FIG. 13C is a cross-sectional view taken from the third location indicated in FIG. 12. As seen in FIG. 13C, an arcuate manifold 1330 extends in a small arc in a portion of housing 1101 that faces the rear of main rotor 1201. Manifold 1330 is connected to channel 1242.

FIG. 13D is a cross-sectional view taken from the fourth location indicated in FIG. 12. As seen in FIG. 13D, an arcuate manifold 1336 extends in a small arc in a portion of housing 1101 that faces the front of main rotor 1203. Manifold 1336 is connected to channel 1244. In some embodiments, arcuate manifold 1336 extends over approximately 170° of the rotation of rotor 1204 so as to minimize back pressure when a valve in chamber 1243 admits the next charge of heated and compressed air into chamber 1243 and then into an inter-rotor chamber of rotors 1203 and 1204.

Figure 13E:
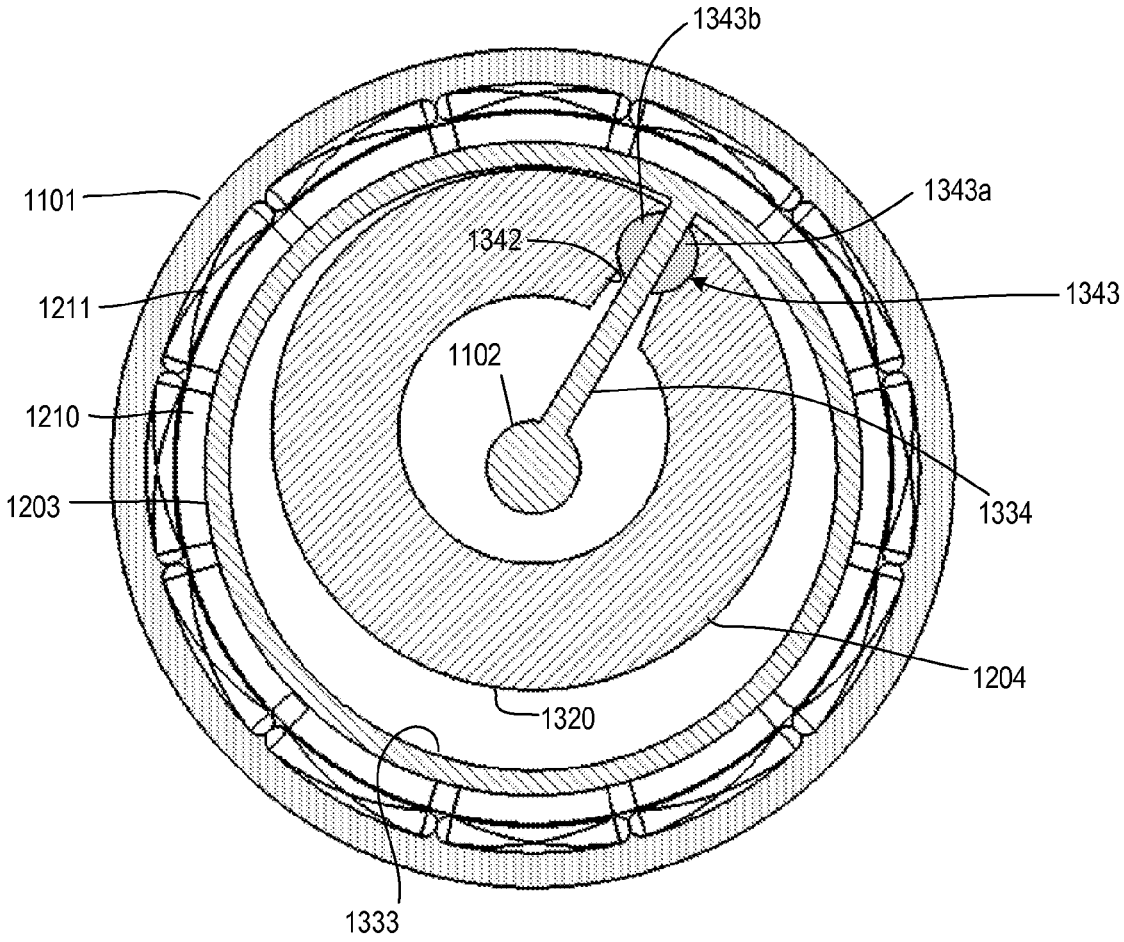

FIG. 13E is a cross-sectional view taken from the fifth location indicated in FIG. 12. A blade 1334 connects the inner perimeter wall 1333 of main rotor 1203 to shaft 1102. Two halves 1343*a* and 1343*b* of a cylindrical split trunnion seal 1343 are contained in a slot 1342 of slotted rotor 1204. Blade 1334 slides between the halves of seal 1343, and seal 1343 can rotated within slot 1342. Seal 1343 operates similar to seal 343 described in connection with engine 100 and prevents gas from passing through slot 1342. As described below in connection with FIGS. 17A-17E, seal 1343 allows creation of expansion and exhaust inter-rotor chambers between wall 1333 and outer circumferential surface 1320 of slotted rotor 1204. Although not shown, leaf seals similar to leaf seals 321 could also be included in surface 1320.

Figure 13F:
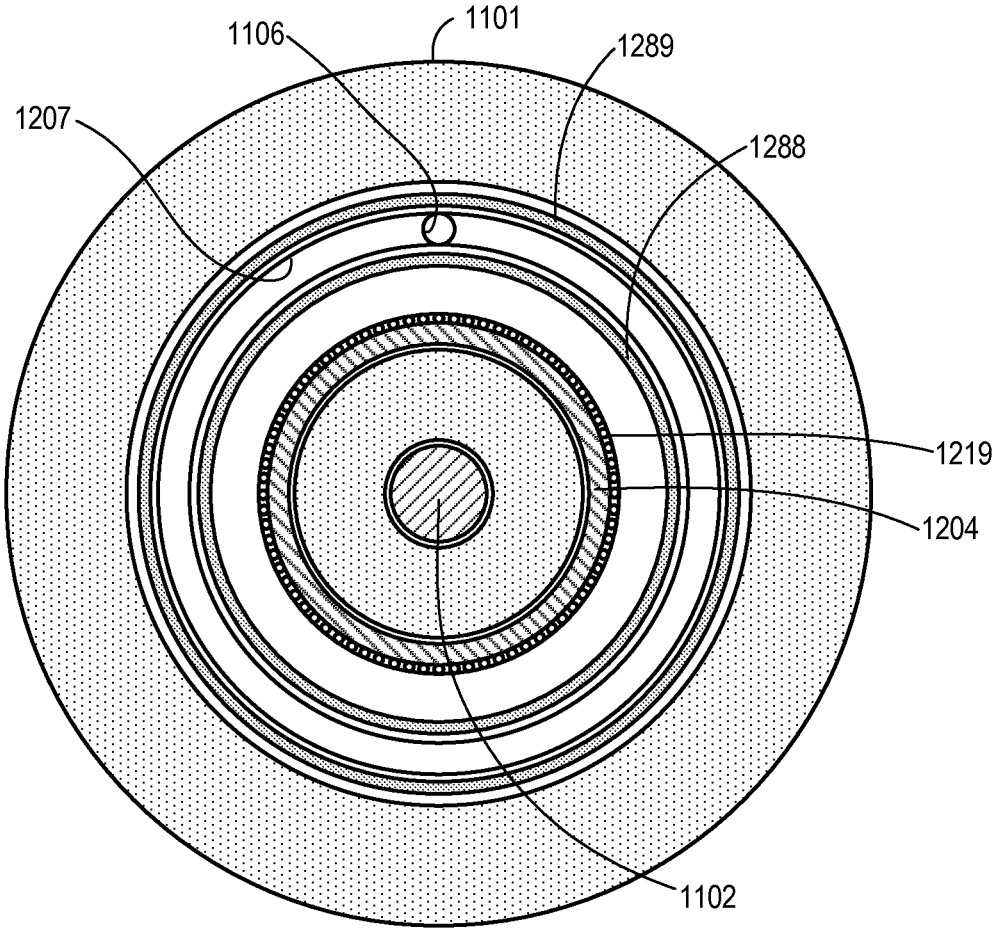

FIG. 13F is a cross-sectional view taken from the sixth location indicated in FIG. 12. As seen more clearly in FIG. 13F, exhaust port 1106 connects to manifold 1207. Manifold 1207 extends around the entire circumference of a portion of housing 1101 that faces the rear of main rotor 1203.

Figure 14A:
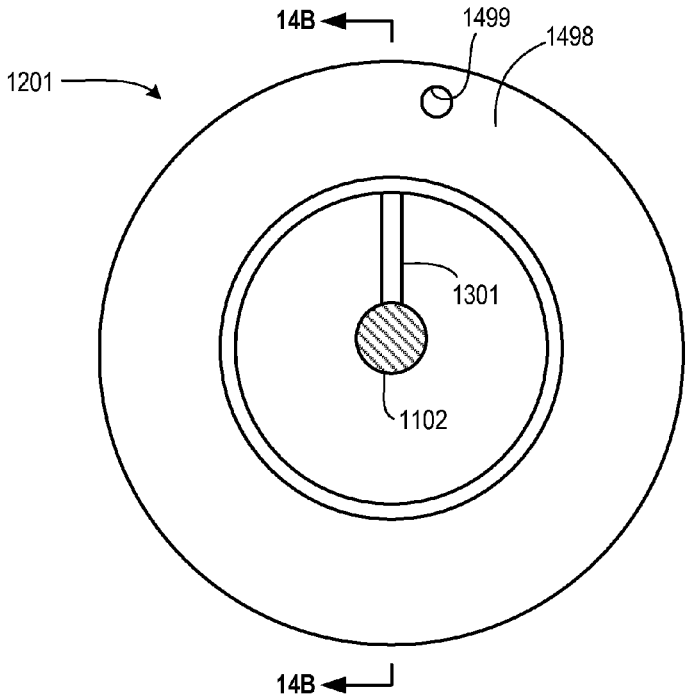
FIGS. 14A-14C show the intake/compression main rotor of the engine and motor/generator of FIGS. 11A-11C.
Figure 14B:
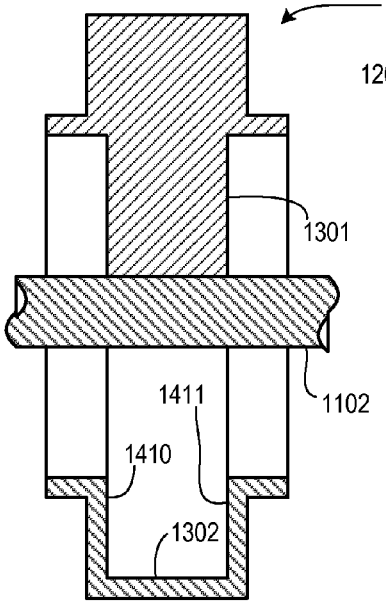
Figure 14C:
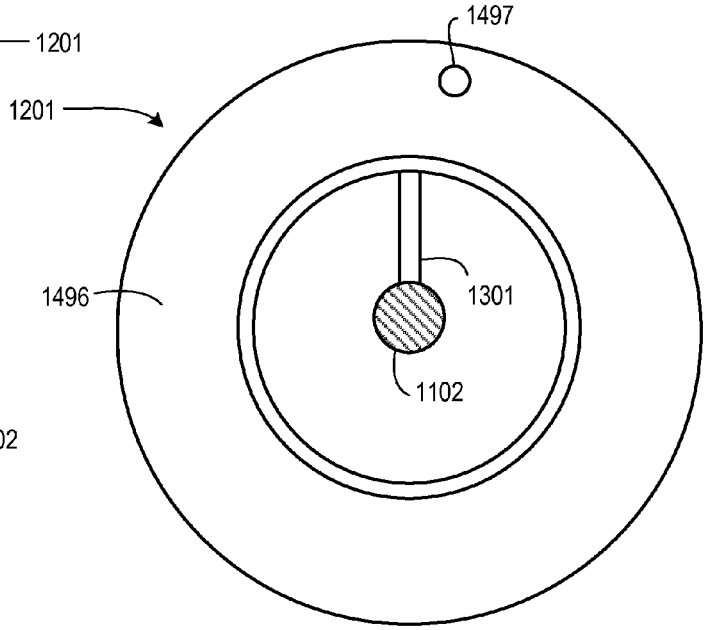

FIG. 14A is a front view of main rotor 1201 removed from engine 1100 but attached to shaft 1102. FIG. 14B is a cross-sectional view of main rotor 1201 and shaft 1102 from the location indicated in FIG. 5A. FIG. 14C is a rear view of main rotor 1201 removed from engine 1100 but attached to shaft 1102. For convenience, rotor 1201 has been rotated approximately 30° from the position indicated in FIG. 13B so as to place blade 1301 at top dead center. Rotor 1203 may be substantially identical to rotor 1201. Rotors 1201 and 1203 can be formed from aluminum or other suitable material. As seen in FIG. 14A, blade 1301 extends downward and is connected to shaft 1102. As seen in FIG. 14B, blade 1301 is attached to the inside of rotor 1201 at the inner perimeter wall 1302, the inner front wall 1410 and the inner rear wall 1411.

An intake opening 1499 in the front 1498 of rotor 1201 cooperates with manifold 1206 so as to allow air into an inter-rotor intake chamber between rotors 1201 and 1202. A similar opening in the front of rotor 1203 cooperates with manifold 1336 so as to allow heated and compressed gases to flow into an inter-rotor expansion chamber between rotors 1203 and 1204. An outlet opening 1497 in the rear 1496 of rotor 1201 cooperates with manifold 1330 so as to allow heated and compressed gas to flow from an inter-rotor compression chamber between rotors 1201 and 1202 into channel 1242. A similar opening in the rear of rotor 1203 cooperates with manifold 1207 so as to allow exhaust to flow from an inter-rotor exhaust chamber between rotors 1203 and 1204 into exhaust port 1106.

Although FIGS. 14A through 14C show rotor 1201 and shaft 1102 as a monolithic element for simplicity, each of rotors 1201 and 1203 could be formed from multiple pieces that can be disassembled so as to allow insertion of a slotted rotor, and then reassembled so as to contain that slotted rotor. An end of blade 1301 could rest within a groove cut in shaft 1102. Similarly, an end of blade 1334 of main rotor 1203 could rest within another groove cut in shaft 1102.

Figure 15A:
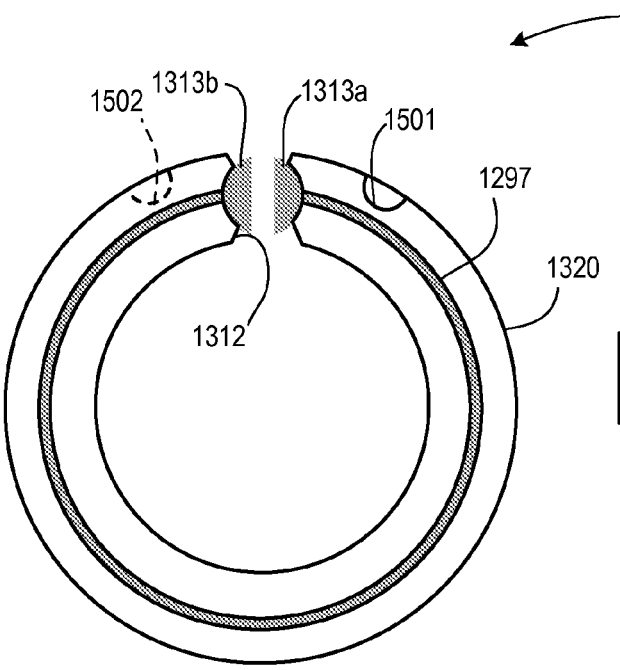
FIGS. 15A-15C are front, top and rear views, respectively, of the intake/compression slotted rotor of the engine and motor/generator of FIGS. 11A-11C.
Figure 15B:
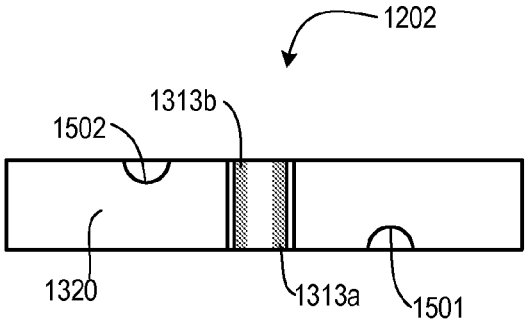
Figure 15C:
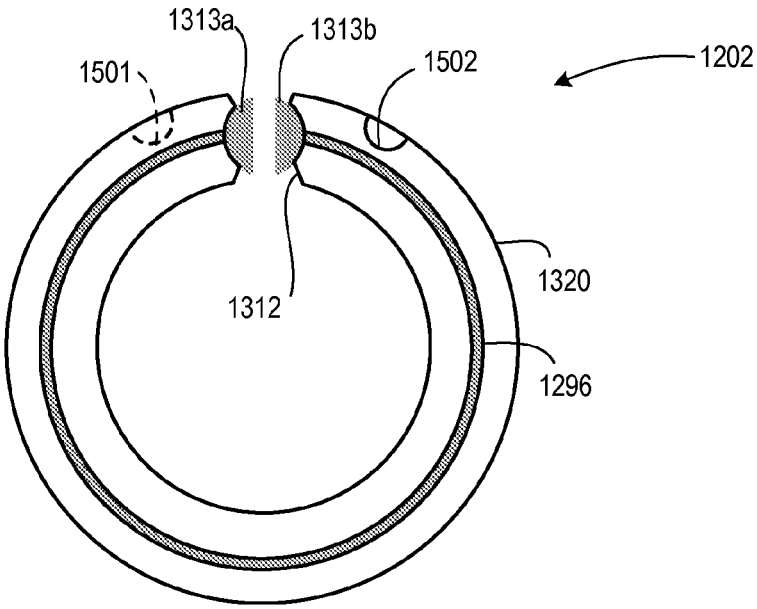

FIGS. 15A-15C are front, top and rear views, respectively, of slotted rotor 1202. Slotted rotor 1204 is substantially identical. For convenience, rotor 1202 is rotated approximately 30° from the position shown in FIG. 13B so as to place slot 1312 at top dead center. A first notch 1501 is formed in the front of rotor 1202 and cooperates with opening 1499 in rotor 1201. A second notch 1502 is formed in the rear of rotor 1202 and cooperates with opening 1497 in rotor 1201. A notch in the front of rotor 1204 similar to notch 1501 cooperates with an opening in rotor 1203 similar to opening 1499 in rotor 1201. A notch in the rear of rotor 1204 similar to notch 1502 cooperates with an opening in rotor 1203 similar to opening 1497 in rotor 1201.

FIGS. 16A through 16E are partially schematic drawings showing relative positions of main rotor 1201 and slotted rotor 1202 at selected times during a complete revolution of rotors 1201 and 1202. Similar to engine 100, rotors 1201 and 1202 will make two complete rotations (i.e., each will rotate 720°) during an intake/compression cycle. Stated differently, each intake/compression cycle includes two rotational cycles. The first half of each cycle is an intake half-cycle. During the intake half-cycle, air is drawn into an inter-rotor intake chamber between rotors 1201 and 1202 during a first revolution (i.e., the first 360° of rotation). The second half of each intake/compression cycle is a compression half-cycle. During the compression half-cycle, which occurs during a rotation that immediately follows the rotation of the intake half-cycle (i.e., the second 360° of rotation), the intake chamber becomes a compression chamber and the air is compressed. Rotors 1201 and 1202 simultaneously perform two separate and overlapping intake/compression cycles as they rotate. During any given rotation, rotors 1201 and 1202 are performing the intake half-cycle of one intake/compression cycle and the compression half-cycle of a separate intake/compression cycle.

Each of FIGS. 16A through 16E is an area cross-sectional view of rotors 1201 and 1202 taken from the plane used for FIG. 13B. The view in each of FIGS. 16A through 16E is facing toward the rear of engine 1100. For simplicity, the locations of manifolds 1206 and 1330, as well as the locations of openings 1499 and 1497, have not been projected onto the sectioning planes of FIGS. 16A-16E. However, the locations of those manifolds and openings can be readily deduced by comparing FIGS. 16A-16E with FIGS. 13A-13C, 14A and 14C.

Figure 16A:
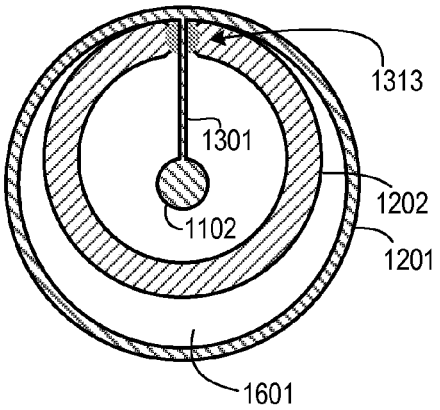
FIGS. 16A-16E are partially schematic drawings showing relative positions of the intake/compression slotted and main rotors of the engine and motor/generator of FIGS. 11A-11C at selected times during operation.

Each of rotors 1201 and 1202 rotates counterclockwise in FIGS. 16A-16E. Torque from shaft 1102 rotates main rotor 1201. The force of blade 1301 rotates slotted rotor 1202. In FIG. 16A, both of rotors 1201 and 1202 are at top dead center. Rotors 1201 and 1202 are about to begin the intake half-cycle of one intake/compression cycle and the compression half-cycle of a separate intake/compression cycle. An inter-rotor compression chamber 1601 has a volume defined by inner perimeter wall 1302 of rotor 1201, by outer face 1320 of rotor 1202, and by portions of front inner wall 1410 and rear inner wall 1411. Chamber 1601 contains air that was drawn through manifold 1206 and opening 1499 in an intake half-cycle that occurred during the immediately preceding revolution of rotors 1201 and 1202.

Figure 16B:
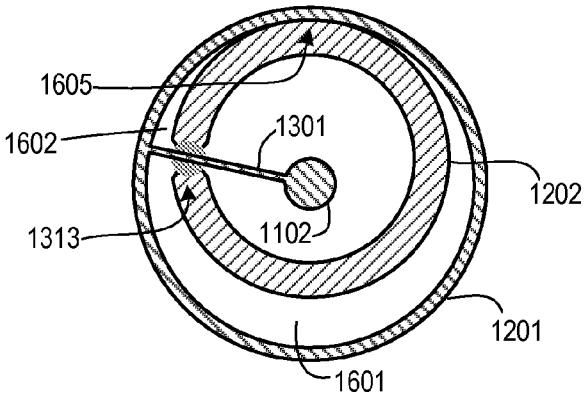

In FIG. 16B, rotors 1201 and 1202 have rotated counterclockwise. Trunnion seal 1313 has rotated slightly clockwise and blade 1301 has started to emerge from slotted rotor 1202. The volume of compression chamber 1401 is reduced. Specifically, chamber 1401 is bounded on one end by blade 1301 and at the other end by an inter-rotor seal 1605 resulting from the rolling contact between outer face 1320 of rotor 1202 and inner wall 1302 of rotor 1201. As rotors 1201 and 1202 rotate, the ends of chamber 1601 become closer and the volume of chamber 1601 is thus reduced. The reduction of volume in chamber 1601 compresses air contained in chamber 1601.

In some embodiments, compression chamber 1401 remains in fluid communication with channel 1242 (FIG. 12) throughout the compression cycle. A valve in chamber 1243 remains closed until a point in the cycle at which compressed gas is allowed to flow from chamber 1243, into channel 1244, and into an inter-rotor chamber of rotors 1203 and 1204.

As also shown in FIG. 16B, separate inter-rotor intake chamber 1602 is created as rotors 1201 and 1202 rotate past top dead center. The volume of chamber 1602 is also bounded by blade 1301 and by the rolling contact seal 1605. As rotors 1201 and 1202 rotate, the ends of chamber 1602 become more separated and the volume of chamber 1602 expands. Fresh air flows from manifold 1206 and into intake chamber 1602 as the volume of chamber 1602 expands.

Figure 16C:
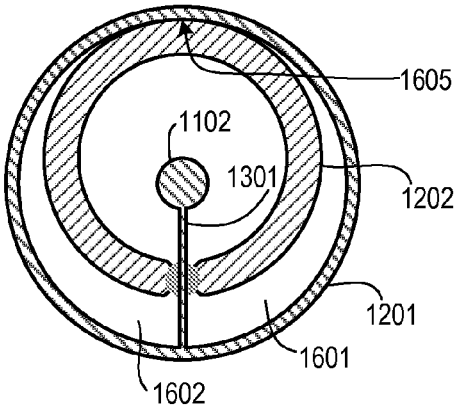

In FIG. 16C, rotors 1201 and 1202 have both rotated 180° from top dead center. Intake chamber 1602 has continued to expand and draw in fresh air through manifold 1206 and opening 1499. Compression chamber 1601 has continued to contract, resulting in further compression of the air contained therein. Seal 1313 has rotated clockwise so as to be in the same position (relative to slotted rotor 1202) as is shown in FIG. 16A. Blade 1301 has reached the point of maximum withdrawal from slot 1312.

Figure 16D:
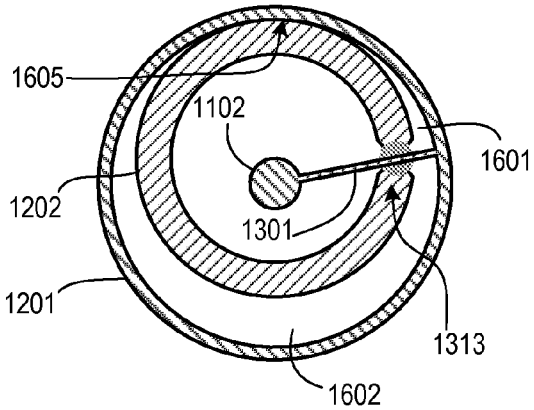

In FIG. 16D, rotors 1201 and 1202 have rotated further. Intake chamber 1602 has continued to expand and draw in fresh air through manifold 1206. Compression chamber 1601 has continued to contract and compress air contained therein. Seal 1313 has now rotated slightly counterclockwise, and blade 1301 has begun to re-enter slot 1312. At approximately this point in the compression cycle, fuel is injected into chamber 1243 (FIG. 12) and ignited, and the valve in chamber 1243 is opened so as to allow the compressed air to escape from chamber 1601, through opening 1497, channel 1242, chamber 1243, channel 1244, manifold 1336, and into an inter-rotor chamber of rotors 1203 and 1204. Operation of rotors 1203 and 1204 is discussed in connection with FIGS. 17A through 17E.

Figure 16E:
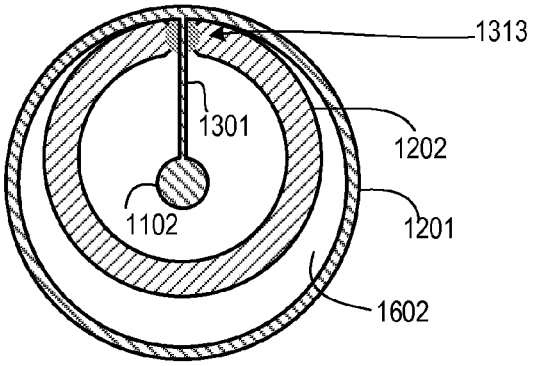

FIG. 16E shows rotors 1201 and 1202 after they have completed the revolution begun in FIG. 16A. The intake/compression cycle for which the compression half-cycle began in FIG. 16A has now completed. The intake/compression cycle for which the intake half-cycle began in FIG. 16A has now completed its intake half-cycle and is about to begin its compression half-cycle. In particular, as rotors 1201 and 1202 again rotate through top dead center, chamber 1602 will become a compression chamber. A new inter-rotor intake chamber will also be formed and will draw in fresh air as part of the intake half-cycle of a new intake compression cycle.

FIGS. 17A through 17E are partially schematic drawings showing relative positions of main rotor 1203 and slotted rotor 1204 at selected times during a complete revolution of rotors 1203 and 1204. During a complete expansion/exhaust cycle, rotors 1203 and 1204 will also make two complete rotations (i.e., each will rotate 720°). Stated differently, each expansion/exhaust cycle includes two rotational cycles. The first half of each expansion/exhaust cycle is an expansion half-cycle. During the expansion half-cycle, compressed air and combustion products are blown into an inter-rotor expansion chamber between rotors 1203 and 1204 as rotors 1203 and 1204 undergo a first revolution (i.e., the first 360° of rotation). The second half of each expansion/exhaust cycle is an exhaust half-cycle. During the exhaust half-cycle, which occurs during a rotation that immediately follows the rotation of the expansion half-cycle (i.e., the second 360° of rotation), the expansion chamber becomes and exhaust chamber. Exhaust in that exhaust chamber is scavenged and forced out through exhaust port 1106. Rotors 1203 and 1204 simultaneously perform two separate and overlapping expansion/exhaust cycles as they rotate. During any given rotation, rotors 1203 and 1204 are performing the expansion half-cycle of one expansion/exhaust cycle and the exhaust half-cycle of a separate expansion/exhaust cycle.

The simultaneous and overlapping expansion/exhaust cycles in rotors 1203 and 1204 occur while simultaneous and overlapping intake/compression cycles occur in rotors 1201 and 1202. However, a respective correspondence between FIGS. 16A-16E and 17A-17E is not necessarily intended. In other words, the rotational phase of rotors 1203 and 1204 represented in one of FIGS. 17A-17E ending with a particular capital letter may or not be the rotational phase that rotors 1203 and 1204 would have when rotors 1201 and 1202 have the rotational phase represented in the one of FIGS. 16A-16E ending with the same capital letter.

Each of FIGS. 17A through 17E is an area cross-sectional view of rotors 1203 and 1204 taken from the plane used for FIG. 13E. The view in each of FIGS. 17A through 17E is facing toward the rear of engine 1100. For simplicity, the locations of manifolds 1336 and 1207, as well as the locations of openings in rotor 1203 similar to openings 1499 and 1497 in rotor 1201, have not been projected onto the sectioning planes of FIGS. 17A-17E. However, the locations of those manifolds and openings can be readily deduced by comparing FIGS. 17A-17E with FIGS. 13D-13F, 14A and 14C.

Figure 17A:
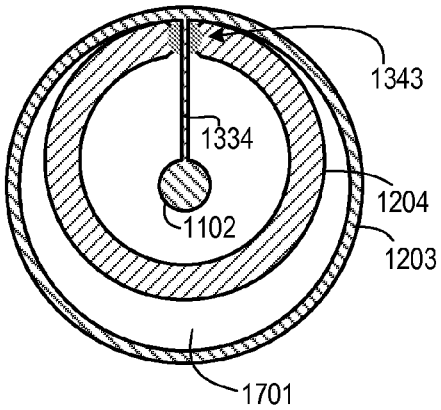
FIGS. 17A-17E are partially schematic drawings showing relative positions of the expansion/exhaust slotted and main rotors of the engine and motor/generator of FIGS. 11A-11C at selected times during operation.

In FIG. 17A, both of rotors 1203 and 1204 are at top dead center. Rotors 1203 and 1204 are about to begin the expansion half-cycle of one expansion/exhaust cycle and the exhaust half-cycle of a separate expansion/exhaust cycle. The volume of an inter-rotor exhaust chamber 1701 is defined by inner perimeter 1333 of rotor 1203, by outer face 1350 of rotor 1204, and by portions of front and rear inner walls of rotor 1203. Chamber 1701 contains exhaust that remains after compressed air and combustion products were forced through manifold 1336 and an opening in the front of rotor 1203 (similar to opening 1499 in the front of rotor 1201) during the preceding revolution.

Figure 17B:
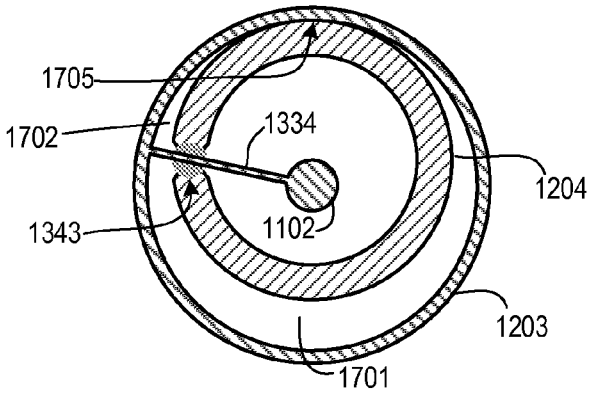

In FIG. 17B, rotors 1203 and 1204 have rotated clockwise as a result of the momentum from the previous revolution. Trunnion seal 1343 has rotated slightly clockwise and blade 1334 has withdrawn slightly from slot 1342. An inter-rotor expansion chamber 1702 has also formed. The volume of chamber 1702 is bounded at one end by blade 1334 and at the other end by an inter-rotor seal 1705 resulting from the rolling contact between outer face 1350 of rotor 1204 and inner face wall of rotor 1203.

Because manifold 1336 coincides with the opening in the front of rotor 1203, heated and compressed gas (air and combustion products) can easily flow from combustion chamber 1243, through channel 1244, manifold 1336, and the rotor 1203 front opening and into expansion chamber 1702. The expansive pressure of this heated and compressed gas causes chamber 1702 to further expand. In particular, the expansive pressure pushes blade 1334 away from seal 1705 so as to create more volume to accommodate the expanding gas. The resulting force causes rotors 1203 and 1204 to continue rotating.

As expansion chamber 1702 expands, exhaust chamber 1701 contracts. This contraction forces exhaust gases that remain from a previous expansion half-cycle (during the previous revolution) through an opening in the rear of rotor 1203 (similar to opening 1497 in the rear of rotor 1201), manifold 1207 and exhaust port 1106.

Figure 17C:
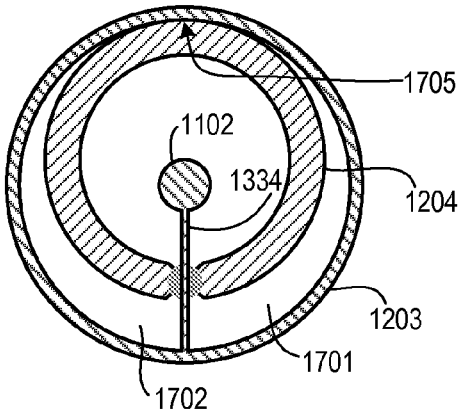

In FIG. 17C, rotors 1203 and 1204 have both rotated 180° from top dead center. Continued expansion of gas in chamber 1702 continues to impart rotational forces on rotors 1203 and 1204. Chamber 1701 continues to contract, thereby continuing the scavenging and evacuation of exhaust gases. Seal 1343 has rotated clockwise so as to be in the same position (relative to slotted rotor 1204) as is shown in FIG. 17A. Blade 1334 has reached the point of maximum withdrawal from slot 1342.

Figure 17D:
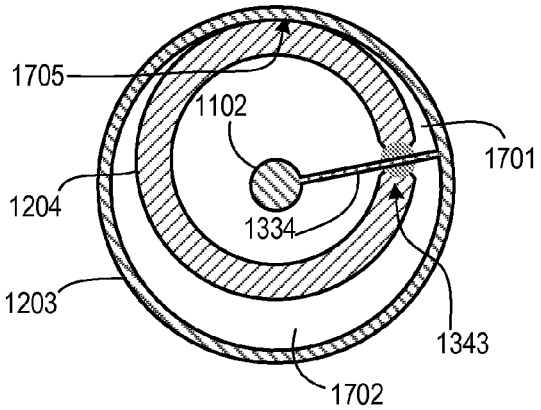

In FIG. 17D, rotors 1203 and 1204 have continued to rotate in response to expanding gases in chamber 1702. Exhaust chamber 1701 has continued to contract and scavenge exhaust. Seal 1343 has rotated counterclockwise and blade 1334 has begun re-entry into slot 1342.

Figure 17E:
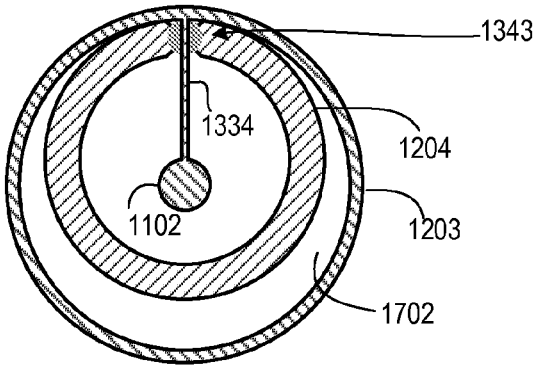

FIG. 17E shows rotors 1203 and 1204 after they have completed the revolution begun in FIG. 17A. The expansion/exhaust cycle for which the exhaust half-cycle began in FIG. 17A has now completed. The expansion/exhaust cycle for which the expansion half-cycle began in FIG. 17A has now completed that expansion half-cycle and is about to begin its exhaust half-cycle. In particular, as rotors 1203 and 1204 again rotate through top dead center, chamber 1702 will become an exhaust chamber. A new inter-rotor expansion chamber will also be formed and will receive a new injection of heated and compressed gas from combustion chamber 1243 as part of the expansion half-cycle of a new expansion/exhaust cycle.

Figure 20A:
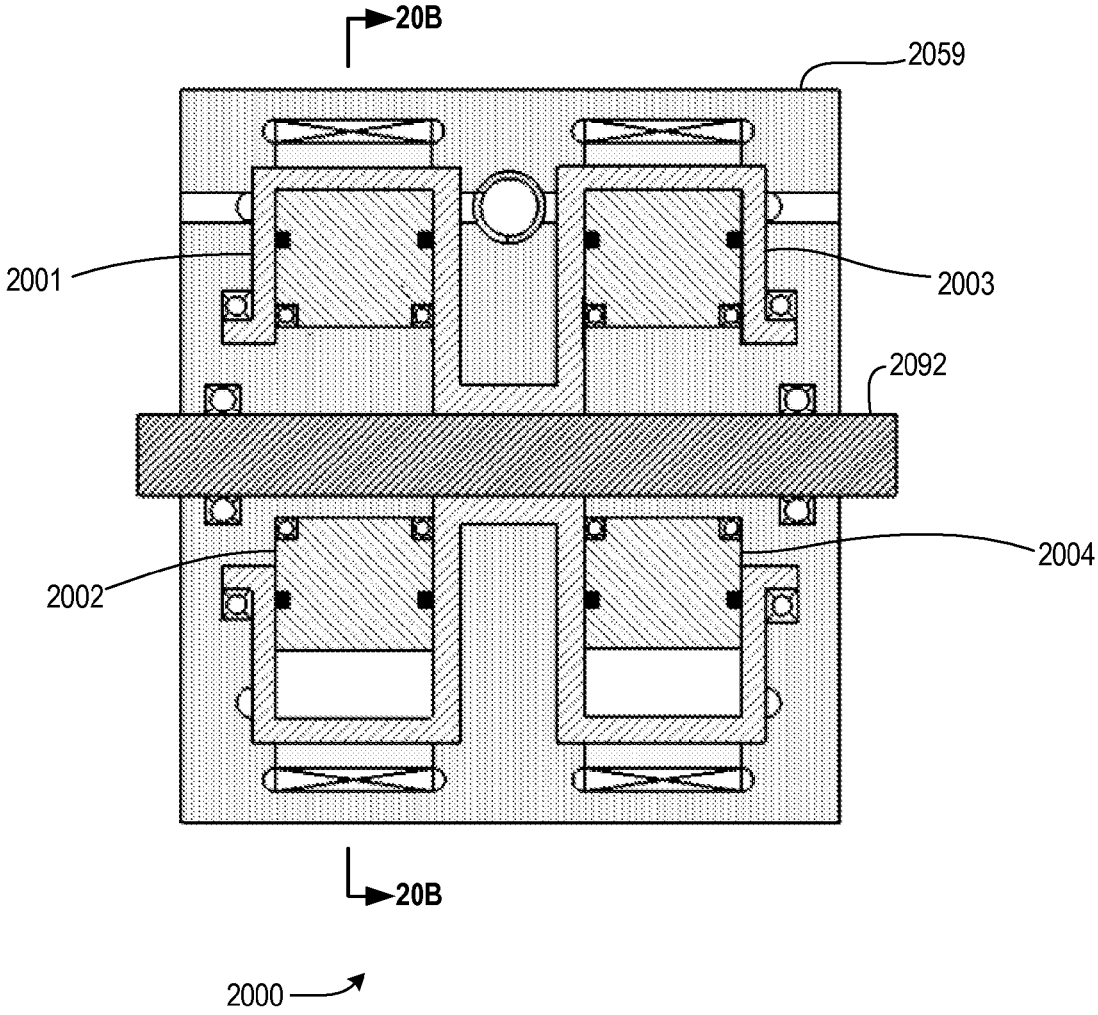
FIGS. 20A and 20B are cross-sectional views of a combination rotary engine and motor/generator according to certain additional embodiments.
Figure 20B:
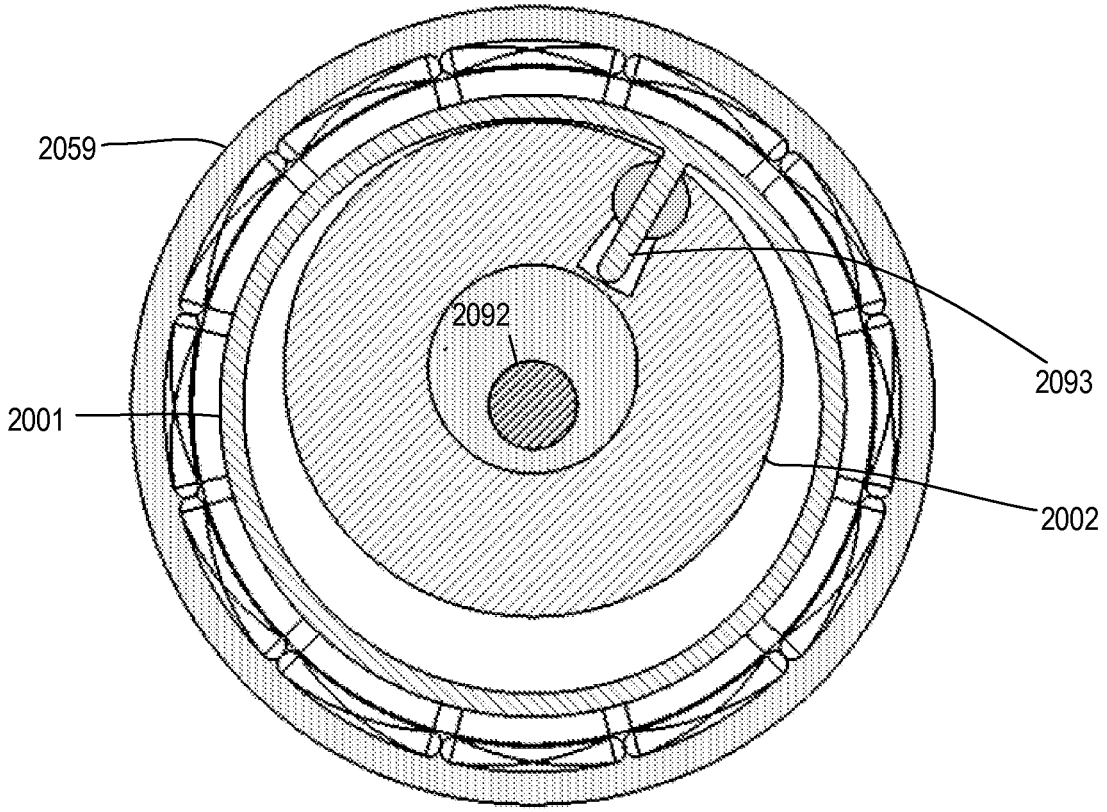

FIG. 20A is a cross-sectional view of a combination engine and motor/generator 2000. FIG. 20B is a cross-sectional view taken from the location shown in FIG. 20A. Engine 2000 includes main rotors 2001 and 2003 and slotted rotors 2002 and 2004 rotatably supported by bearings in a housing 2059. Engine 2000 is similar to engine 1100, except that rotors 2001 and 2003 are connected to each other and to a shaft 2092. This connection reduces the torque on the main rotor blades (e.g., blade 2093 as shown in FIG. 20B).

Figure 18:
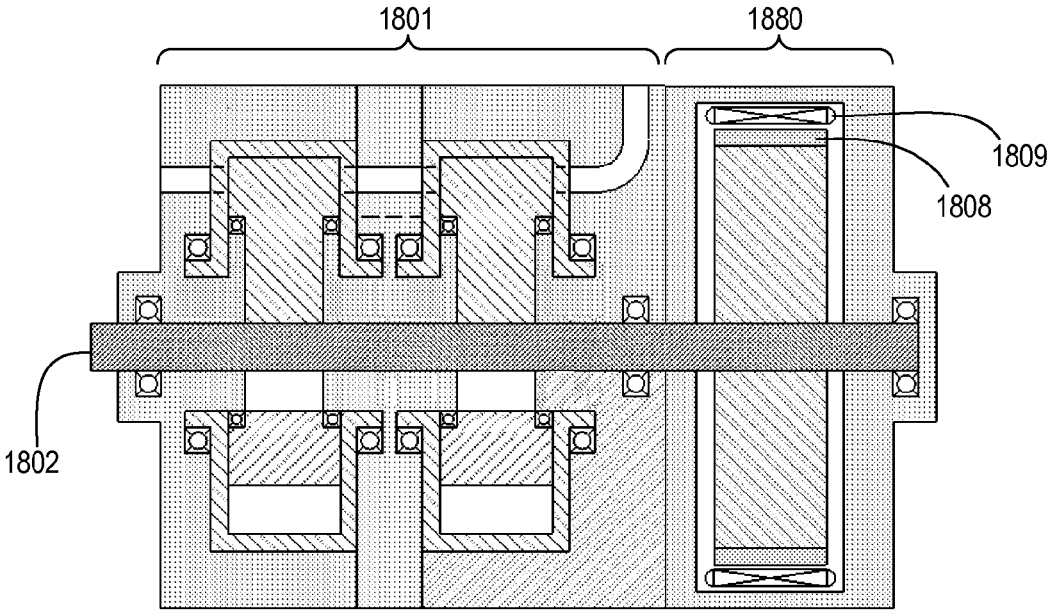
FIG. 18 shows a rotary internal combustion engine and coupled motor/generator according to another embodiment.

In the embodiments described thus far, armatures and stators for a motor/generator encircle the main rotors of a rotary internal combustion engine and are contained in the same housing. Other embodiments include rotary internal combustion engines similar to those previously described, but in which motor/generator components are included within the same housing but do not encircle the main rotors. One example of such an embodiment is shown in FIG. 18. FIG. 18 is a cross-sectional view taken from a location similar to the locations used for FIGS. 2, 10 and 12. Rotary internal combustion engine 1800 is similar to engine 1101, but lacks armatures and stators that encircle the main rotors. A separate motor/generator 1880 (having armature 1808 and stator 1809) is coupled to a shaft 1802 of engine 1800. In still other embodiments, a separate motor/generator in a separate housing can be coupled to the shaft of a rotary internal combustion engine.

Figure 19:
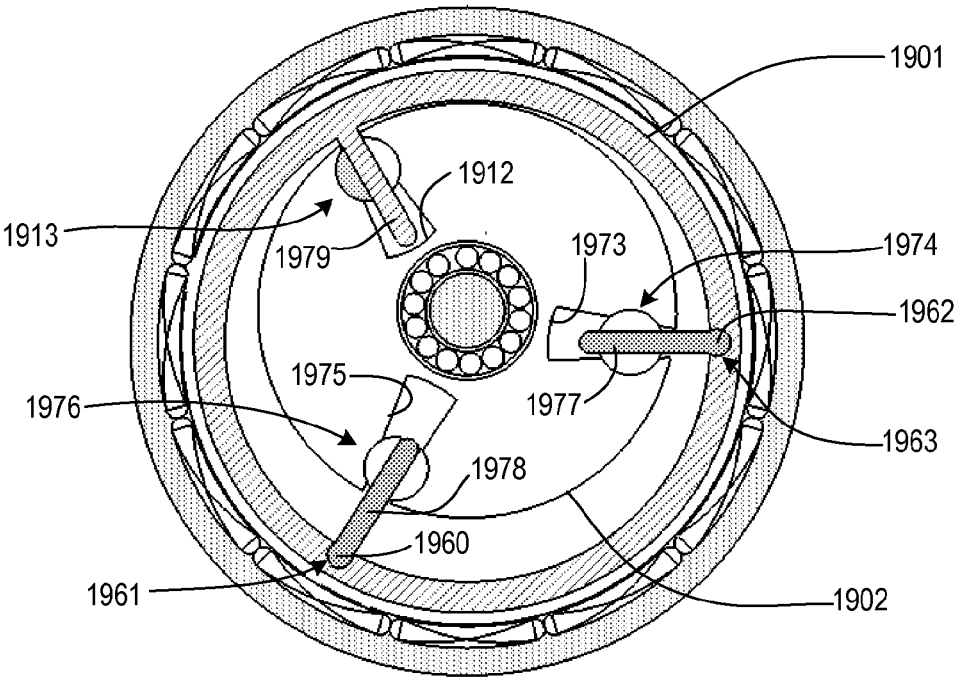
FIG. 19 is a cross-sectional view of a main rotor and slotted rotor pair according to another embodiment.

In the embodiments of FIGS. 1-18, 20A and 20B, each main rotor included a single blade. In other embodiments, a main rotor may have additional blades. FIG. 19 is a partially schematic cross-sectional view of the main and slotted rotors from one such embodiment. FIG. 19 shows a main rotor 1901 having a fixed blade 1979 and two swinging blades 1978 and 1977. Fixed blade 1979 fits within a split trunnion seal 1913 in slot 1912. As rotors 1901 and 1902 rotate, blade 1979 moves within slot 1912 in a manner similar to that described in connection with blade 301. Blade 1978 fits within a split trunnion seal 1976 in slot 1975. End 1960 of blade 1978 is captured in a groove 1961 and acts as a hinge pivot for blade 1978. Blade 1977 fits within a split trunnion seal 1974 in slot 1973. End 1962 of blade 1977 is captured in a groove 1963 and acts as a hinge pivot for blade 1977. The sides of blade 1979 are fixed to the inner walls of main rotor 1901 in a manner similar to that shown in connection with rotor 201. The sides of blades 1978 and 1977 form sliding seals that swing across the inner walls of main rotor 1901.

The addition of blades 1978 and 1977 creates two additional inter-rotor chambers between rotors 1901 and 1902. In a main/slotted rotor pair used for compression, these additional chambers can be used for additional compression stages. In a main/slotted rotor pair used for expansion, these additional chambers can be used for additional expansion stages. Other embodiments include main rotors with a single fixed blade and a single swing blade. Other embodiments include main rotors with more than two swing blades.

FIGS. 21A-21F are partially schematic drawings showing relative positions of a main rotor 2101 and a slotted rotor 2102 according to another embodiment at selected times during a rotational cycle. FIGS. 21A-21F are cross-sectional views based on a sectioning plane similar to the sectioning planes used in connection with FIGS. 6A-6F, 7A-7F, 16A-16E and 17A-17E.

Rotors 2101 and 2102 are similar to rotors 1201 and 1202 (and to rotors 1203 and 1204) in that a blade 2193 is fixed to an inside perimeter surface of main rotor 2101 and rotates about the same axis as main rotor 2101. Seal 2113 is similar to seals 1313 and 1343. Unlike the embodiment of rotors 1201 and 1202, however, blade 2193 is attached to an inner hub rotor 2191. Hub rotor 2191 is attached to a shaft 2192. Shaft 2192 can be coupled to another group of rotors and/or to external components. Main rotor 2101, hub rotor 2191, shaft 2192 and blade 2193 all rotate about a common axis (which common axis is centered on shaft 2192 in FIGS. 21A-21F). Slotted rotor 2102 rotates about another axis that is parallel to and offset from that common axis.

Figure 21A:
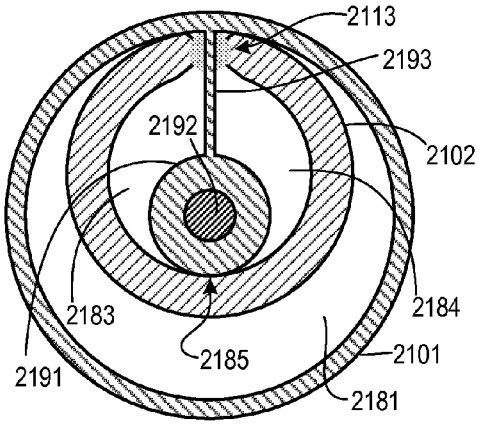
FIGS. 21A-21F are partially schematic drawings showing relative positions of slotted and main rotors according to another embodiment at selected times during operation.

Hub rotor 2191 and blade 2193 operate so as to create two additional chambers that contract and expand as the rotors rotate. In particular, an outer surface of hub rotor 2191 makes rolling contact with an inner perimeter wall of slotted rotor 2102 so as to create an inter-rotor seal 2185. Leaf seals could also be included on the outer surface of hub rotor 2191 to help create seal 2185. As seen in FIG. 21A, two interior chambers 2183 and 2184 exist when the rotors are at top dead center. Each of chambers 2183 and 2184 is bounded at ends by seal 2185 and by blade 2193. The front and rear sides of chambers 2183 and 2184 could be formed by interior surfaces of main rotor 2101 and/or by interior surfaces of a housing (not shown). An outer chamber 2181 (similar to chambers 1601 and 1701) is also visible in FIG. 21A.

Figure 21B:
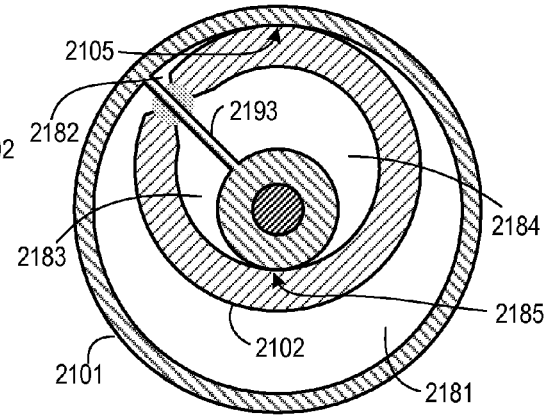

In FIG. 21B, rotors 2101, 2102 and 2191 have rotated clockwise. An outer chamber 2182 (similar to chambers 1602 and 1702) is formed between blade 2193 and inter-rotor seal 2105. Outer chamber 2181 and inner chamber 2183 have contracted Inner chamber 2184 has expanded.

Figure 21C:
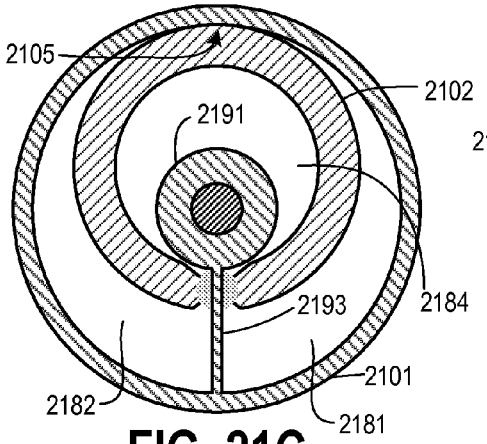

FIG. 21C shows rotors 2101, 2102 and 2191 rotated 180° counterclockwise. Inner chamber 2183 is now gone, and inner chamber 2184 has reached maximum expansion. Outer chamber 2181 has continued to contract and outer chamber 2182 has continued to expand.

Figure 21D:
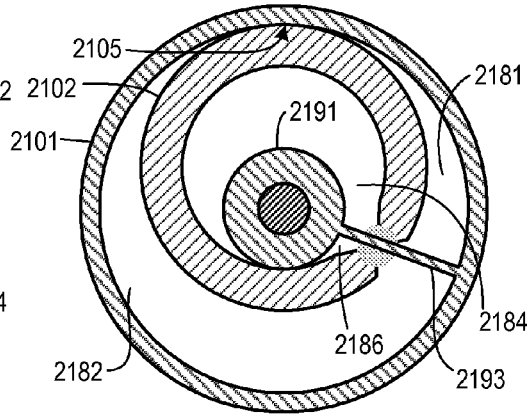

FIG. 21D shows rotors 2101, 2102 and 2191 rotated counterclockwise past 180°. Outer chamber 2181 has continued to contract. Outer chamber 2182 has continued to expand Inner chamber 2184 has begun to contract. A new inner chamber 2186 has formed between blade 2193 and inter-rotor seal 2185.

Figure 21E:
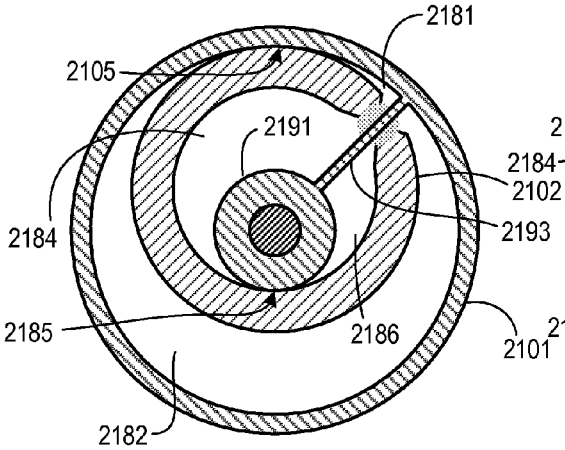

FIG. 21E shows rotors 2101, 2102 and 2191 rotated further counterclockwise. Outer chamber 2181 and inner chamber 2184 have continued to contract. Outer chamber 2182 and inner chamber 2186 have continued to expand.

Figure 21F:
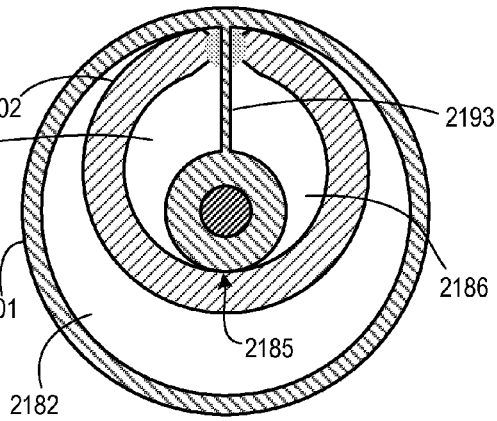

FIG. 21F shows rotors 2101, 2102 and 2191 returned to top dead center Inner chamber 2184 is now similar to chamber 2183 in FIG. 21A. Inner chamber 2186 is now similar to chamber 2184 in FIG. 21A. Outer chamber 2181 has vanished, and outer chamber 2182 is now similar to chamber 2181 in FIG. 21A.

An arrangement of rotors similar to rotors 2101, 2102 and 2191 can be used, with appropriate ducting and manifold(s), to combine intake/compression and power/exhaust into one set of rotors. For example, inner chambers could be used for intake and compression, with compressed air from an inner chamber ducted to an expansion outer chamber. An arrangement of rotors similar to rotors 2101, 2102 and 2191 could alternatively be used for multi-stage compression or for multi-stage expansion.

Although various embodiments include engines having one main/slotted rotor pair for intake and compression and another main/slotted rotor pair for expansion and exhaust, other embodiments may have different configurations. An embodiment can include a main/slotted rotor pair such as is described in a preceding embodiment, but which is not used with another main/slotted rotor pair. For example, a main/slotted rotor pair could be coupled to an electric motor and used as a compressor. As another example, a main/slotted rotor pair could be connected to a source of surplus heated gas (e.g., gas bled from a gas turbine engine) and used as an auxiliary power unit. An embodiment could also have one or more stages of compressive main/slotted rotor pairs coupled to one or more stages of expansion main/slotted rotor pairs.

Still other embodiments may include multiple slotted rotors within a single main rotor and/or having one or more swing blades, such as are described in the aforementioned provisional patent application 61/313,833.

In some embodiments, a rotating valve or other type of valve could be located in an intake port (e.g., any ports 105, 905 or 1105) and timed with the rotation of an intake/compression rotor pair so as to cutoff air intake at certain points in a rotational cycle. In embodiments in which two or more main/slotted rotor pairs are used in an engine, the rotational cycles of the rotor pairs need not be in phase (e.g., one pair could be at top dead center while another pair is off top dead center). In at least some embodiments, however, the phases of an intake/compression rotor pair and an expansion/exhaust rotor pair are timed so that there is sufficient volume in an inter-rotor exhaust chamber to accept heated and compressed gas released by a valve in a channel between the two rotor pairs. In some embodiments, channels within a shaft could be used, in conjunction with one or more valves inside of a slotted rotor, to facilitate inflow to and outflow from inter-rotor chambers.

Internal combustion engines and other systems utilizing main and slotted rotor pairs such as are described above can offer numerous advantages. Such systems may require fewer moving components and seals. Known low friction and/or self-lubricating materials can be used for surfaces in sliding or rolling contact so as to further reduce energy loss, heating and wear. Positive displacement geometries according to some embodiments may provide over 270 degrees of compression of the intake air or of a fuel/air mixture and combustion gas expansion during each 360 degree blade rotation. Chamber dimensions and fluid transfer ports can be sized for intake air compression ratios from, e.g., 6 to 20, and combustion gas exhaust at near atmospheric pressure. Energy efficient operation and low exhaust emissions can be achieved using conventional and alternative fuels. The use of hard, durable, low friction materials and coatings on load bearing surfaces can provide an engine that is able to operate reliably with oil lubrication, fuel lubrication, or perhaps un-lubricated. Embodiments can include engines and other systems able to operate at high rotational speeds (e.g., 60,000 rpm or more). Engines and other systems according to various embodiments can include rotors of widely varying size. For example, some embodiments may include main rotors of less than one inch in diameter. As another example, some embodiments may have main rotors with diameters of several feet or more.

A rotary engine and motor/generator according to at least some embodiments would be compact and lightweight, have a high power density, and could provide an efficient power source for a hybrid electric vehicle or other applications. Main and slotted rotor pairs such as those described herein can also be incorporated into fluid compressors, fluid pumps, fluid driven motor/generators, turbochargers, and other systems.

Some embodiments may utilize fuel as a lubricant and/or to increase blade seals. Internal combustions engines according to various embodiments can use various fuels (e.g., gasoline, diesel, biofuels, other alternative fuels).

Set forth below is a non-exhaustive list of features that may be present in some of the above described embodiments and/or in other embodiments. All embodiments need not have all of the features described below (or above), and the below listing is not intended as a listing of essential features.

A rotary internal combustion engine can include a housing with one or more cavities. Each cavity may contain a main rotor, a smaller slotted rotor mounted on a parallel axis offset with respect to the main rotor axis, intake and exhaust ports, a combustion chamber with fuel injector(s) or a carburetor, an ignition source (e.g., a spark plug, glow plug, or compression heating, depending on the fuel). A blade can be mechanically attached and sealed to the interior radial surface of the main rotor and to the interior sides of a cavity within the main rotor. A slot in the slotted rotor is sealed to the blade side surfaces, and the slot seals slide reciprocally along the blade with each rotation of the rotors. As the main rotor and the slotted rotor rotate at the same rotational velocity (rpm), a portion of the exterior surface of the slotted rotor maintains near contact with a portion of the interior surface of the main rotor cavity, thereby creating inter-rotor chambers on opposite sides of the blade that expand and contract with each rotation. The changing volumes of these sealed chambers can perform four-cycle internal combustion engine functions of air or fuel-air mixture intake, compression, combustion-expansion, and exhaust.

An internal combustion engine may or may not include a power shaft, and may or may not include an integrated motor/generator. The motor/generator may include an armature located on an outer surface of a main rotor and a stator located on an inside surface of the housing surrounding the main rotor. The combination of an efficient, light weight, high power density engine and motor/generator, with the addition of a battery for starting the engine and for providing and storing electrical power, would be suitable for, e.g., a hybrid electric vehicle or other generator set applications. Drive train power for a hybrid electric vehicle could be provided by the rotary internal combustion engine, the motor/generator, a separate electric traction motor, or any combination of the these elements.

In addition to a fixed main rotor blade, additional blades can be added that extend through transverse slots in the slotted rotor, or terminate in transverse slots in the slotted rotor. The additional blades can be pivotally attached by hinge fittings to the main rotor axel or hub, or to the interior surface of the main rotor drum.

A tangential or near tangential contact between the exterior surface of a slotted rotor and the radially interior surface of a main rotor, in combination with a blade, can define crescent-shaped sealed working inter-rotor chambers. In certain embodiments and applications, a tangential or near tangential contact between a radially interior surface of a slotted rotor and an exterior surface of the main rotor hub, in combination with the blade, may define radially interior sealed working chambers. Transversely-mounted, evenly or non-evenly spaced, limited extension radial seals can be placed around the inside surface of the main rotor cavity or the outside surface of the slotted rotor. The spacing and radial extension of the seals could be proportioned to ensure that at least one seal is always in sealed contact between the inside surface of the main rotor cavity and the outside surface of the slotted rotor between the intake and exit ports. For example, rearward facing pressure compensated leaf seals could be spaced at +/−30 degrees from the main rotor blade, and four additional leaf seals at 60 degree radial spacing between these two seals. Similarly, pressure compensated forward facing leaf seals could be located at 60 degree intervals along the inside surface of the main rotor cavity or the outside surface of the slotted rotor. In certain embodiments, the limited radial extension seals around the inside surface of the main rotor cavity or the outside surface of the slotted rotor could be leaf seals, foil seals, hinged swing seals, sliding vane seals, roller seals, or the like. The seals between the blade sides and the slot in the slotted rotor could be industry standard blade seal materials. The sliding surfaces of the seals could preferably be low friction self-lubricated, fuel lubricated, or un-lubricated material.

An engine or other system could include a single shaft mounted on the slotted rotor, with the main rotor being mounted on an offset parallel axis relative to the slotted rotor axis. An engine or other system could include a single shaft mounted on the main rotor, with the slotted rotor being mounted on an offset parallel axis relative to the main rotor axis. An engine or other system may lack a shaft; the main rotor could be mounted for rotation in the end plates of the housing, and the slotted rotor mounted for rotation in the housing on an offset parallel axis relative to the main rotor axis.

A blade seal can comprise two generally part-cylindrical shaped seals which fit in a substantially cylindrical seating in the rotor, with the blade being positioned between the two part-cylindrical seals.

An engine or other system can include a plurality of limited-radial-extension seals mounted transversely around the exterior surface of the slotted rotor. The limited radial extension seals can be proportioned to provide an effective seal between the slotted rotor and the outer perimeter wall of the main rotor cavity over an arc that bounds the location where the radial exterior surface of the slotted rotor and the main rotor peripheral wall are in near tangential contact. Alternatively (or additionally), such seals could be mounted in the peripheral wall.

A blade may be mechanically affixed and sealed to the main rotor cavity. The blade may also be mechanically affixed (and possibly sealed to) a main rotor shaft.

A combustion chamber can be located in a transfer channel between an output of an inter-rotor compression chamber from one main/slotted rotor pair and an intake port of an inter-rotor combustion gas expansion chamber (or power chamber) of a second main/slotted rotor pair. The transfer channel can have a check valve (or other one way valve) located near the output of the compression chamber. In some embodiments, the combustion chamber is in a rotary valve in the transfer channel between the output of the compression chamber and the intake of the combustion gas expansion chamber.

In some embodiments, an inter-rotor combustion chamber is located in the space defined by the interior surface of a main rotor cavity and the exterior surface of the slotted rotor (e.g., chambers 702, 1702). In these and other embodiments, a fuel/air mixture can be transferred into an inter-rotor compression chamber (e.g., chambers similar to chambers 601, 1601) from a carburetor located upstream of the intake/compression main/slotted rotor pair. In other embodiments, fuel is injected into an inter-rotor compression chamber by a fuel injector. In still other embodiments, fuel is injected by a fuel injector into the transfer channel (or into a rotary valve or rotary cylinder compression valve in the transfer channel) between the output of the inter-rotor compression chamber and the intake port of the inter-rotor expansion chamber.

In some embodiments, fuel is injected by a fuel injector into an inter-rotor space defined by the interior surface of the main rotor cavity and the exterior surface of the slotted rotor in the expansion/exhaust main/slotted rotor pair.

Other embodiments include engines with multiple fuel injection locations and/or multiple ignition locations, as well as embodiments in which combustion, once initiated by an ignition source, is self-sustaining.

An engine according to some embodiments may include additional combustion gas expanders in communication with the power chamber exhaust port to drive an additional compression chamber that serves as a positive displacement turbocharger to provide pressurized intake air to the engine compression chamber.

An engine according to some embodiments may include one or more additional blades mounted concentrically around the exterior surface of the main rotor axle or hub. The additional blades may extend through transverse slots in the slotted rotor and extend to the interior surface of the main rotor. The additional blades can be pivotally attached (e.g., by hinge fittings) to the main rotor axel or hub with seals in blade ends and side slots biased by springs, fluid pressure, centrifugal force, or other means to maintain sealed contact with the interior surfaces of the main rotor cavity.

An engine according to some embodiments may include one or more additional blades mounted transversely around the interior surface of the main rotor cavity. The additional blades may extend through transverse slots in the slotted rotor, or terminate in transverse slots in the slotted rotor. The additional blades may be pivotally attached (e.g., by hinge fittings) to the interior perimeter surface of the main rotor cavity, with seals in vane ends and side slots to maintain sealed contact with other interior surfaces of the main rotor cavity.

An engine according to some embodiments may include an intake port for the induction of the air or a fuel/air mixture into an inter-rotor compression chamber and an exhaust transfer tube and port for transferring compressed air or fuel/air mixture through the transfer tube into the power (combustion products expansion) inter-rotor chamber. The transfer tube could contain a check valve (ball check valve, foil check valve, reed check valve, leaf check valve, dual plate check valve, swing check valve, lift check valve, etc.), a rotary valve, a rotary cylinder compression valve, and the like. The transfer tube and valve can also house a fuel injector and ignition source.

An engine according to some embodiments can include an always-open intake port for the induction of air or fuel/air mixture into an inter-rotor compression chamber and an always-open exhaust port for the exhaust of combustion products (gas) from an inter-rotor exhaust chamber.

An engine according to some embodiments can be configured for discharge of air or fuel/air mixture into a manifold, ahead of the blade in an inter-rotor compression chamber, and the further transfer into the space behind the blade in an inter-rotor power (expansion) chamber, when low friction gas seals in the housing (e.g., within +45 and −45 degrees of the rotors' near contact line) are aligned with openings in the sides of the main and/or slotted rotors during each rotation of the rotors.

Embodiments include engines and other systems that are air or liquid cooled.

Embodiments include engines and other systems in which the rotation of the main rotor and the slotted rotor at the same rotational velocity (rpm) is synchronized by the sliding contact between the blade and the blade seals in the slot in the slotted rotor. Embodiments also include engines and other systems in which rotation of the main rotor and the slotted rotor at the same rotational velocity (rpm) is synchronized by gears, belts, rods, hinges, etc.

Embodiments include engines and other systems in which certain load bearing surfaces include one or more of (i) a hard material coating based on one of borides, carbides and nitrides, (ii) a super-hard steel, (iii) a self-lubricating material, and (iv) a diamond-like carbon coating.

Embodiments include engines and other systems in which at least one of the load bearing surfaces includes a low friction diamond-like carbon coating.

Embodiments include oil lubricated, fuel lubricated and un-lubricated engines.

Embodiments include engines configured to use one or more of the following as fuel: liquefied petroleum gas, bio-diesel, butanol, natural gas, biogas, methanol, Fischer-Tropsch fuel, ethanol, n-pentene, hexane, n-heptane, isooctane, and hydrogen.

Embodiments further include fuel-lubricated engines wherein an additive to the fuel includes one or more of molybdenum disulfide, graphite, soybean derived oil, canola oil, polytetrafloeraethylene (PTFE), zinc dialkyldithiophosphate, polyalphaolefin, ashless fatty-ester, polybutenyl succinimide, ashless aliphatic-amine, dibasic organic esters, and mineral oil.

In some embodiments that include multiple main and slotted rotor pairs, all of the main rotors need not turn about axes that coincide with one another, and all of the slotted rotors need not rotate about coincident axes. For example one main/slotted rotor pair may include a first shaft coupled to the slotted rotor of the first rotor pair. A second slotted rotor pair may include a second shaft coupled to the slotted rotor of the second rotor pair. The first and second shafts may turn about axes that are not coincident, and which may not even be parallel. The first and second shafts could be coupled by gears or mechanical elements configured to transfer rotating motion.

In some embodiments, slotted rotors could be linked in a manner similar to that by which rotors 1001 and 1003 are connected (e.g., a flange attached to each of the two slotted rotors.

Various types of bearings can be used to rotatably support shafts, rotors and other rotating members in various embodiments. Such bearing types include, e.g., ball bearings, roller bearings, tapered roller bearings, fluid bearings, air bearings, foil air bearings, magnet bearings, and the like.

The foregoing description of embodiments has been presented for purposes of illustration and description. The foregoing description is not intended to be exhaustive or to limit embodiments to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. All embodiments need not necessarily achieve all objects or advantages identified above. Any and all permutations of various features described herein are within the scope of the invention. As used herein, two components are "in fluid communication" if gas or other fluid can flow from one component to another. Such flow may be by way of one or more intermediate (and not specifically mentioned) other components. Such flow may or may not be selectively interruptible (e.g., with a valve) or metered.

The invention claimed is:

1. An apparatus comprising:

a first rotor having a cavity therein defined by first and second inner side walls and by an inner perimeter wall, the first rotor mounted so as to rotate about a first axis;

a second rotor having an outer face, first and second sides, a slot formed in a region of the outer face, and a seal contained within the slot, the second rotor mounted so as to rotate about a second axis parallel to and offset from the first axis;

a shaft fixed relative to the second rotor and mounted so as to rotate about an axis coincident with the second axis;

a blade fixed to the inner perimeter wall and to the first and second inner side walls, a portion of the blade extending into the slot and the seal, and wherein a portion of the second rotor rests within the cavity, and the outer face is configured for rolling contact with the inner perimeter wall; and a plurality of limited radial extension swing seals, wherein each of the swing seals comprises a first end coupled to the outer face of the second rotor, and comprises a second end biased away from the outer face of the second rotor and toward the inner perimeter wall of the first rotor.

2. The apparatus of claim 1, wherein the first side includes a first side opening formed therein, the outer face includes a first outer face opening formed therein, and a first internal channel of the second rotor connects the first side opening and the first outer face opening.

3. The apparatus of claim 2, further comprising a housing containing the first and second rotors, the housing including a first manifold located in a portion of the housing adjacent a portion of the first side, wherein the apparatus is configured so that the first side opening at least partially coincides with part of the first manifold during at least a portion of a revolution of the first and second rotors.

4. The apparatus of claim 1, wherein each of the limited radial extension swing seals comprises a leaf element.

5. The apparatus of claim 4, wherein each of the leaf elements is coated with low friction carbon.

6. The apparatus of claim 1, wherein the first and second rotors are configured so as to alternately expand and contract a first inter-rotor chamber during the course of two full revolutions of the first and second rotors, the first inter-rotor chamber having a first end defined by the blade and a second end resulting from the rolling contact between the first and second rotors.

7. An apparatus comprising:

a first rotor having a cavity therein defined by first and second inner side walls and by an inner perimeter wall, the first rotor mounted so as to rotate about a first axis;

a second rotor having an outer face, first and second sides, a slot formed in a region of the outer face, and a seal contained within the slot, the second rotor mounted so as to rotate about a second axis parallel to and offset from the first axis, wherein the first side includes a first side opening formed therein, the outer face includes a first outer face opening formed therein, a first internal channel of the second rotor connects the first side opening and the first outer face opening the second side includes a second side opening formed therein, the outer face includes a second outer face opening formed therein, the first outer face opening and the second outer face opening located on opposite sides of the slot, and a second internal channel of the second rotor connects the second side opening and the second outer face opening;

a shaft fixed relative to the second rotor and mounted so as to rotate about an axis coincident with the second axis;

a blade fixed to the inner perimeter wall and to the first and second inner side walls, a portion of the blade extending into the slot and the seal, and wherein a portion of the second rotor rests within the cavity, and the outer face is configured for rolling contact with the inner perimeter wall; and a housing containing the first and second rotors, the housing including a first manifold located in a portion of the housing adjacent a portion of the first side, wherein the apparatus is configured so that the first side opening at least partially coincides with part of the first manifold during at least a portion of a revolution of the first and second rotors.

8. The apparatus of claim 7, wherein the housing includes a second manifold located in a portion of the housing adjacent a portion of the second side, wherein the apparatus is configured so that the second side opening at least partially coincides with a part of the second manifold during a portion of a revolution of the first and second rotors.

9. The apparatus of claim 8, wherein the first side opening at least partially coincides with a part of the first manifold during an entire revolution of the first and second rotors.

10. The apparatus of claim 8, further comprising:

a third rotor having a second cavity therein defined by third and fourth inner side walls and by a second inner perimeter wall, the third rotor mounted so as to rotate about the first axis;

a fourth rotor having a second outer face, third and fourth sides, a second slot formed in a region of the second outer face, and a second seal contained within the second slot, the fourth rotor mounted so as to rotate about the second axis; and a second blade fixed to the second inner perimeter wall and to the third and fourth inner side walls, a portion of the second blade extending into the second slot and the second seal, and wherein a portion of the fourth rotor rests within the second cavity, and the second outer face is configured for rolling contact with the second inner perimeter wall.

11. The apparatus of claim 10, wherein the shaft is fixed relative to the fourth rotor.

12. The apparatus of claim 11, wherein the third side includes a third side opening formed therein, the second outer face includes a third outer face opening formed therein, a third internal channel of the fourth rotor connects the third side opening and the third outer face opening, the fourth side includes a fourth side opening formed therein, the second outer face includes a fourth outer face opening formed therein, the third outer face opening and the fourth outer face opening located on opposite sides of the second slot and a fourth internal channel of the fourth rotor connects the fourth side opening and the fourth outer face opening.

13. The apparatus of claim 12, wherein the housing includes a third manifold located in a portion of the housing adjacent a portion of the third side, wherein the apparatus is configured so that the third side opening at least partially coincides with a part of the third manifold during a portion of a revolution of the third and fourth rotors, the second and third manifolds are connected by a transfer channel, and the housing includes a fourth manifold located in a portion of the housing adjacent a portion of the fourth side, wherein the apparatus is configured so that the fourth side opening at least partially coincides with a part of the fourth manifold during at least a portion of a revolution of the third and fourth rotors.

14. The apparatus of claim 13, wherein the fourth side opening at least partially coincides with a part of the fourth manifold during an entire revolution of the third and fourth rotors.

* * * * *